US009993714B1

(12) United States Patent
Grill

(10) Patent No.: US 9,993,714 B1
(45) **Date of Patent: *Jun. 12, 2018**

(54) PUTTING TRAINER

(71) Applicant: David Glenn Grill, Wilsonville, OR (US)

(72) Inventor: David Glenn Grill, Wilsonville, OR (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/283,056

(22) Filed: Sep. 30, 2016

Related U.S. Application Data

(63) Continuation of application No. 14/689,063, filed on Apr. 17, 2015, now Pat. No. 9,457,254.

(51) Int. Cl.
*A63B 69/36* (2006.01)

(52) U.S. Cl.
CPC ..... *A63B 69/3688* (2013.01)

(58) Field of Classification Search
USPC ..... 473/219–257, 595, 614
See application file for complete search history.

(56) References Cited

U.S. PATENT DOCUMENTS

| | | | | |
|---|---|---|---|---|
| 1,988,377 | A | 1/1935 | Samuel et al. | |
| 2,078,382 | A | 4/1937 | Hanshaw | |
| 2,950,115 | A | 8/1960 | Hurdzan | |
| 3,357,705 | A | 12/1967 | Blanchard et al. | |
| 3,918,720 | A | 11/1975 | Gordos | |
| 3,951,414 | A | 4/1976 | Nunez | |
| 4,278,254 | A | 7/1981 | Simjian | |
| 4,494,757 | A | 1/1985 | Simjian | |
| D289,534 | S | 4/1987 | Davis | |
| 4,700,949 | A | 10/1987 | Nottoli | |
| 4,921,255 | A | 5/1990 | Taylor | |
| 5,573,212 | A | 11/1996 | Palazzolo | |
| 5,595,546 | A | 1/1997 | Masters | |
| 5,882,267 | A | 3/1999 | Roe | |
| 5,904,624 | A | 5/1999 | Martinez | |
| 6,511,384 | B1 | 1/2003 | Villacorta | |
| 6,634,955 | B2 | 10/2003 | Middleton | |
| 6,702,688 | B2 * | 3/2004 | Hale | A63B 69/3676 473/226 |
| 7,115,042 | B2 | 10/2006 | Gulan et al. | |
| D631,523 | S | 1/2011 | Pingalore | |
| 8,162,773 | B1 | 4/2012 | Pingalore | |
| 9,457,254 | B1 * | 10/2016 | Grill | A63B 69/3688 |
| 2006/0063623 | A1 | 3/2006 | Zheng | |
| 2011/0218064 | A1 | 9/2011 | Bibby | |
| 2011/0300961 | A1 | 12/2011 | Lacognata | |

OTHER PUBLICATIONS

In the Hole Golf, "Accu Roll," www.intheholegolf.com/Acc-Roll/Accu-Roll.html, at least as early as Mar. 24, 2015, 3 pages.

(Continued)

*Primary Examiner* — Nini Legesse
(74) *Attorney, Agent, or Firm* — Law Office of Karen Dana Oster, LLC

(57) ABSTRACT

A putting trainer, as described herein, is used for practicing golfing with a golf club with a head. The putting trainer is for use on a generally smooth putting surface. The putting trainer has a body and at least one obstacle.

30 Claims, 29 Drawing Sheets

(56) References Cited

OTHER PUBLICATIONS

Broken Tee Custom Golf, LLC, "Circle of Trust," www.circleoftrustgolf.com, at least as early as Mar. 24, 2015, 2 pages.
Golf Training Aids, "Ever Square," www.golftrainingaids.com/Ever-Square/productinfo/EVERSQUARE/, at least as early as Mar. 24, 2015, 3 pages.
Target, Inc., "Magic Sliders," www.target.com/p/magic-sliders-table-chair-pack/, at least as early as Apr. 16, 2015, 4 pages.
Staples, Inc., "Mighty Mite Furniture Sliders," www.staples.com/Mighty-Mite-Furniture-Sliders-2-1-4-inch-4-Pack/, at least as early as Apr. 16, 2015, 3 pages.
Golf Training Aids, "Square Triangle," www.golftrainingaids.com, at least as early as Mar. 24, 2015, 1 page.

* cited by examiner

PUTTING TRAINER

BACKGROUND OF THE INVENTION

Described herein are a putting trainer and, more specifically, a convenient, pocket-sized, putting trainer that may be suitable for use on smooth surfaces.

Golf is a sport whose origins extend back many hundreds and possibly thousands of years. While it is known that the modern game of golf originated in Scotland during the 15th century, some claim the sport derives from the first century BC, when the Romans played a game called paganica, in which players tried to hit a stuffed leather ball with bent sticks. Other historians cite the Chinese game of chuiwan, played between the 8th and 14th centuries. Chuiwan means "to strike a small ball." Other potential origins of golf include the games of cambuca (England), chambot (France), chaugán (Persia) and kolven (the Netherlands).

The first written record of the game of golf occurred in 1457 with the banning of the game by James II. In 1502, James IV lifted the ban and became a golfer himself. According to *The Scottish Golf Book*, the ground on the east coast of Scotland was perfect for golf, with mile upon mile of links, as the land was known, gently undulating and covered in springy turf. The Musselburgh Links in East Lothian, Scotland, is certified by the *Guinness World Records* as the oldest golf course in the world.

The Society of St. Andrews Golfers, a local golf club playing at the links at St. Andrews, was founded in 1754. In 1764, St. Andrews reduced the number of holes on their golf course from 22 to 18. An 18 hole golf course soon became the standard for golf courses.

Two Scotsmen from Dunfermline, school friends John Reid and Robert Lockhart, are credited with introducing golf to the U.S. Robert Lockhart, while in Scotland, ordered six golf clubs and two dozen balls from a shop near St. Andrews to bring to his friend John Reid. John Reid, during an early February thaw in 1888, set up a three hole course in a cow pasture across from his house in Yonkers, N.Y. From these humble beginnings, Reid, with some friends, formed the St. Andrews Golf Club, the first in the United States and named after the famed Scottish golfing site.

The United States Golf Association (USGA), formed in 1894, is an association of golf courses, clubs, and facilities and is the governing body of golf for the United States and Mexico. The Royal and Ancient Golf Club of St. Andrews (the "R&A") is currently the ruling authority of golf throughout the world except the United States and Mexico.

Today, roughly 60 million players worldwide play golf, and golf is considered one of the most widely played sports in the world. In the U.S., 26 million people play golf at approximately 15,000 golf facilities. And the numbers of people playing golf are growing. Golfers today tend to be younger, with more women taking up the sport.

Golf, at its very core, involves hitting a golf ball, such as those disclosed in U.S. Pat. No. 4,783,078, U.S. Pat. No. 4,921,255, and U.S. Pat. No. 5,020,803 (the disclosures of which are incorporated herein by reference), with a club, from a tee position to a greens position and into a cup. Golf is scored based on the total number of shots required to move the ball from the tee into the cup on the green.

As with any sport, golfers always want to improve their game. There are weight training programs directed to golfers. Instructional golf DVDs can be watched and golf books can be read. Magazines, from general interest publications such as *Golf Digest or Golf Magazine* to magazines that target a specific type of golfer such as *African American Golfer's Digest* or *Women & Golf* can be subscribed to. All kinds of golf training aids can be purchased that help with every aspect of the golf game, everything from balls to tees, shoes to gloves, range finders and swing analyzers, bags and carts and clubs of all kinds, not to mention practice devices to help golfers drive, chip, and putt like a pro. According to the National Sporting Goods Association (NSGA), consumers spend approximately $3.5 billion on golf equipment every year and the golf economy, including facility operations, golfer supplies, endorsements, tournaments, associations, charities, and golf course capital investment is estimated to be about $70 billion.

There are mechanical devices that have been patented that purport to help develop or improve a golfer's game. For example, U.S. Pat. No. 5,904,624 to Martinez (the "Martinez reference") is directed to a golf putting training device that includes a "U" shaped grip support having a lower grip arm with strap for wrapping around a lower portion of a golf putter grip and an upper grip arm for engaging a butt end on an upper portion of the golf putter grip. The device engages the forearms of the golfer and locks the forearms in place to prevent movement during the putting stroke. Another example is U.S. Pat. No. 4,700,949 to Nottoli (the "Nottoli reference") that is directed to a golf training device that includes a golf putter club, a guide rail, and a trolley that rolls on wheels engaged with the guide rail. The trolley includes hinge plates contacted together by hinge pins that allow a rocking action and a lifting action by the hinge plates, which in turn allow the club to move in an arc to stroke the ball in a straight line to a target. Yet another example is U.S. Pat. No. 3,951,414 to Nunez (the "Nunez reference") that is directed to a device for aligning a golfer's dominant eye with a golf ball and cup. The Nunez device includes a mask that covers the golfer's non-dominant eye and has an opening therein located and sized for allowing the dominant eye to view both the ball and the cup. A weighted cord is attached to the mask in the line of sight of the dominant eye for enabling the dominant eye to be vertically aligned over or behind a golf ball for proper alignment in the act of putting. Another example is found in U.S. Pat. No. 5,882,267 to Roe (the "Roe reference"). The Roe golf putting trainer includes two parallel elongated members connected by a connecting member. A target is in a slidable relationship with the connecting member such that the target is positioned between the first elongated member and the second elongated member. The golfer must put precisely or the putter blade will strike one or both of the elongated members.

U.S. Pat. No. 3,357,705 to Blanchard, U.S. Pat. No. 3,918,720 to Gordos, and U.S. Pat. No. 5,595,546 to Masters describe training devices that have a pair of spherical members (e.g. balls) joined by a flexible or rigid connecting rod. The goal of these and other similar devices is to provide an apparatus for practicing golf ball driving or putting. If the club head contacts one ball before it contacts the other ball, the devices will move in a curved line. However, if both balls are struck at precisely the same time, the ball members will move forward in a straight line.

U.S. Pat. No. 4,278,254 to Simjian and U.S. Pat. No. 4,494,757 to Simjian (jointly referred to as the "Simjian references") describe devices that function in a manner similar to the pair of spherical members joined by a connecting rod. The Simjian references describe golf putting devices that include a set of wheels connected to an actual or simulated golf ball. When the outer wheels of the Simjian devices are struck simultaneously by a putter, the device is propelled forward along a straight path. If only one wheel of the device is struck by a putter, the device will be propelled along a curved path.

Another type of training device is a specially designed golf putter that has a club head or attachment with a recess sized and adapted to receive a golf ball. U.S. Pat. No. 6,634,955 to Middleton, U.S. Pat. No. 6,702,688 to Hale, U.S. Pat. No. 8,162,773 to Pingalore, U.S. Design Pat. No. D631,523 to Pingalore, all described devices that improve the putting stroke of a golfer using a putter as a training device. AccuRoll at InTheHoleGolf.com describes an alignment device that is affixed to the face of a putter and, by putting the golf ball inside the alignment device, the user receives feedback on his stroke path, as the ball will only be released straight towards the target if his is putting on the target line. Circle of Trust-Broken Tee Custom Golf, LLC describes a device that is attached to a putter and a golf ball is inserted into the hole in the center to assist in a straight putter stroke path. GolfTrainingAids.com Square Triangle may be used to self-diagnose alignment tendencies and correct and improve a golfer's stroke, and Ever Square that helps train one's eye to line the putt up straighter.

BRIEF SUMMARY OF THE INVENTION

Described herein are a putting trainer and, more specifically, a convenient, pocket-sized, putting trainer that may be suitable for use on smooth surfaces.

Described herein is a putting trainer for practicing golfing with a golf club with a head, the putting trainer for use on a generally smooth putting surface. The putting trainer has a body and at least one obstacle. The body has a plurality of sides, a top surface, and a bottom surface, at least the bottom surface being generally smooth. The obstacle is associated with at least part of one of the plurality of sides. Contacting the obstacle squarely with the head of the golf club causes the putting trainer to travel in a preferred forward direction, but contacting the obstacle off from square with the head of the golf club causes the putting trainer to travel in an undesired angle.

Preferred putting trainers are generally triangular, having at least three sides. The obstacle preferably protrudes from the one of the plurality of sides.

Preferred putting trainers have a cavity defined in the body. The cavity preferably intersects one of the plurality of sides to form an opening in the one of the plurality of sides. The obstacle preferably protrudes from the opening. If a golf ball is positioned at least partially within the cavity, the obstacle is part of the golf ball protruding from the opening in the one of the plurality of sides.

Preferred putting trainers have at least two obstacles, a first obstacle protruding from a first one of the plurality of sides, and a second obstacle protruding from a second one of the plurality of sides. The first obstacle may be a different type of obstacle than the second obstacle. The first obstacle may be a different size than the second obstacle.

The obstacle may be a removable and replaceable obstacle. The obstacle may be associated with an adapter that is, in turn removable and replaceable from the body. The putting trainer may be an adjustable putting trainer in which the obstacle can be adjusted to different extension distances.

One preferred putting trainer includes a body, a cavity defined in the body, and a protrusion obstacle. The body has a plurality of sides, a top surface, and a bottom surface. At least the bottom surface is generally smooth. The cavity preferably intersects with one of the plurality of sides to form an opening in the one of the plurality of sides. The protrusion obstacle protrudes from the opening in the one of the plurality of sides. Contacting the protrusion obstacle squarely with the head of the golf club causes the putting trainer to travel in a preferred forward direction, but contacting the protrusion obstacle off from square with the head of the golf club causes the putting trainer to travel in an undesired angle.

Another preferred putting trainer includes a generally triangular body and at least two protrusion obstacles. The generally triangular body has three sides, a top surface, and a bottom surface (which is generally smooth). A first protrusion obstacle protrudes from a first one of the sides. A second protrusion obstacle protrudes from a second one of the sides. Contacting one of the protrusion obstacles squarely with the head of the golf club causes the putting trainer to travel in a preferred forward direction, but contacting one of the protrusion obstacles off from square with the head of the golf club causes the putting trainer to travel in an undesired angle.

The subject matter described herein is particularly pointed out and distinctly claimed in the concluding portion of this specification. Objectives, features, combinations, and advantages described and implied herein will be more readily understood upon consideration of the following detailed description of the invention, taken in conjunction with the accompanying drawings.

BRIEF DESCRIPTION OF THE SEVERAL VIEWS OF THE DRAWINGS

The accompanying drawings illustrate various exemplary putting trainers and/or provide teachings by which the various exemplary putting trainers are more readily understood.

Figure 1:
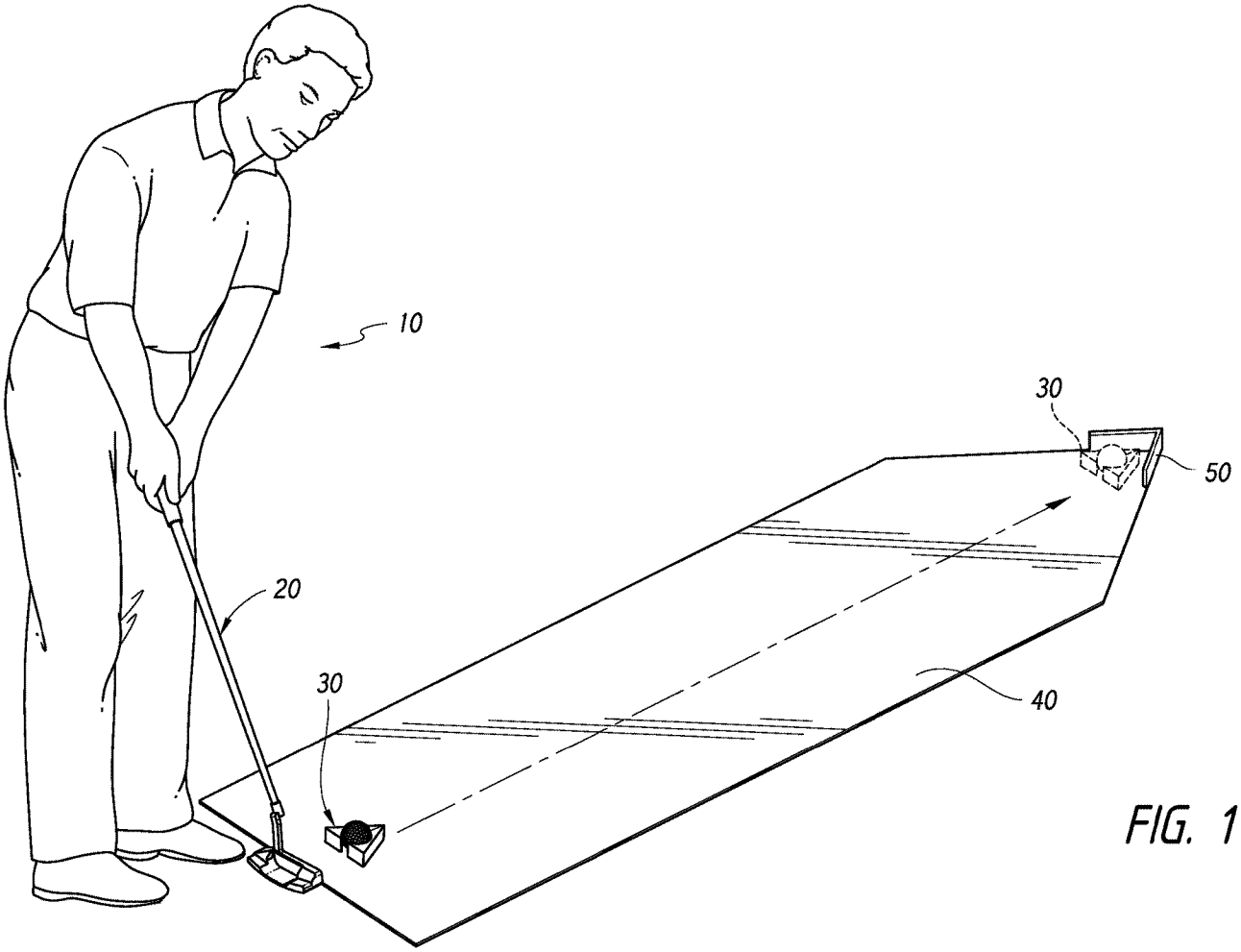
FIG. 1 illustrates an exemplary preferred use of the putting trainer whereby a golfer uses a golf club to contact a putting trainer squarely on its side, the contact sending the putting trainer traveling in the preferred forward direction towards a target at the end of a putting surface.

The drawing figures are not necessarily to scale. Certain features or components herein may be shown in somewhat schematic form and some details of conventional elements may not be shown or described in the interest of clarity and conciseness. The drawing figures are hereby incorporated in and constitute a part of this specification.

DETAILED DESCRIPTION OF THE INVENTION

Figure 2:
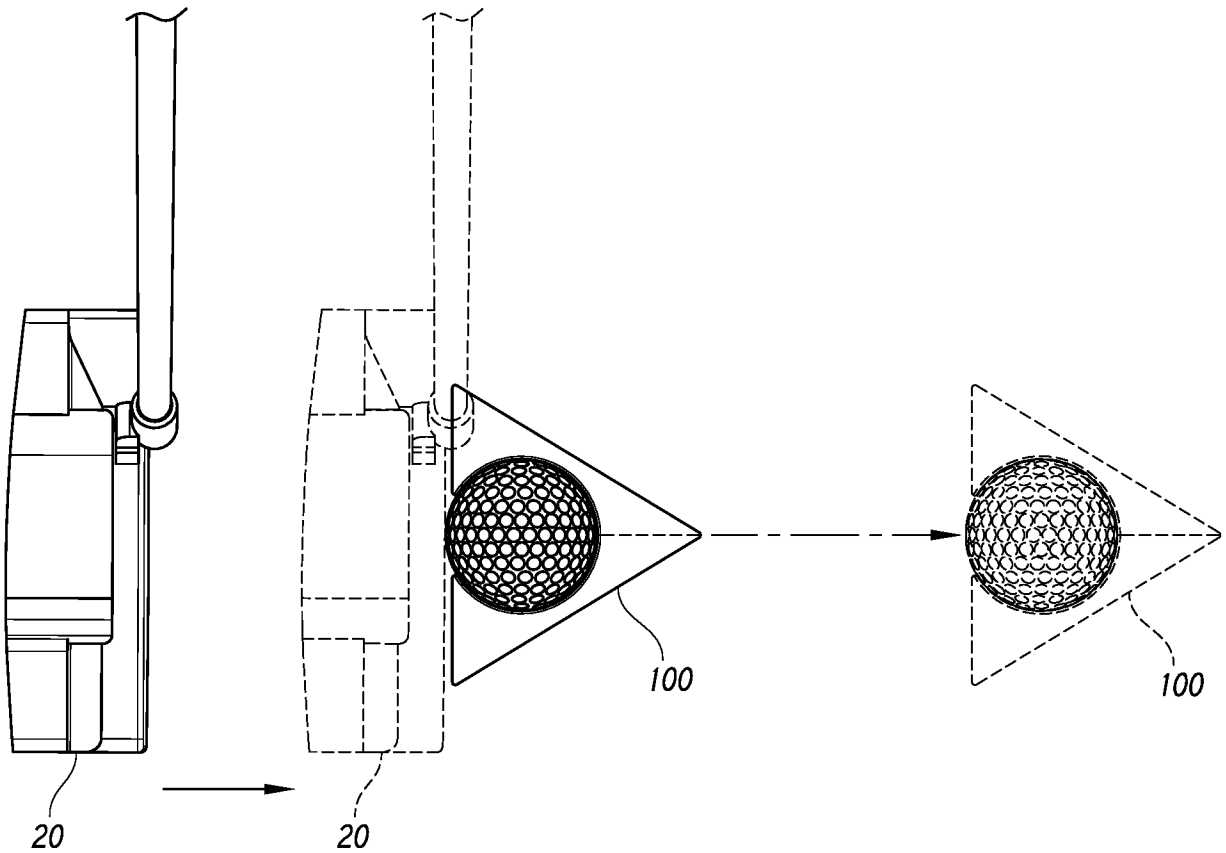
FIG. 2 is a top view of an exemplary preferred first putting trainer positioned in front of a golf club, the golf club contacting squarely with an obstacle associated with a side of the putting trainer, the square contact causing the putting trainer to travel in a preferred forward direction towards the target.
Figure 3:
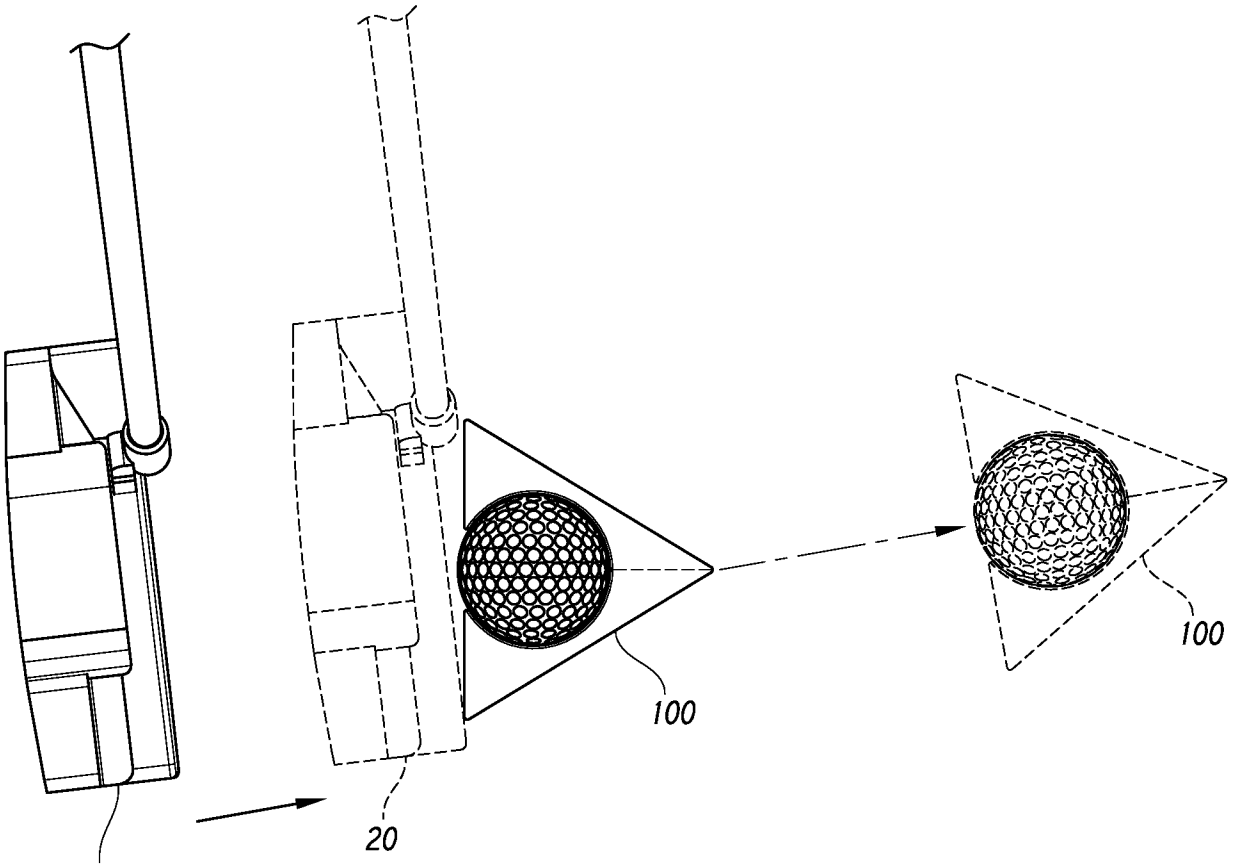
FIG. 3 is a top view of the exemplary preferred first putting trainer of FIG. 2, with the golf club contacting with the putting trainer on the right side of the obstacle such that the putting trainer travels in a leftward direction, which is not the preferred direction.
Figure 4:
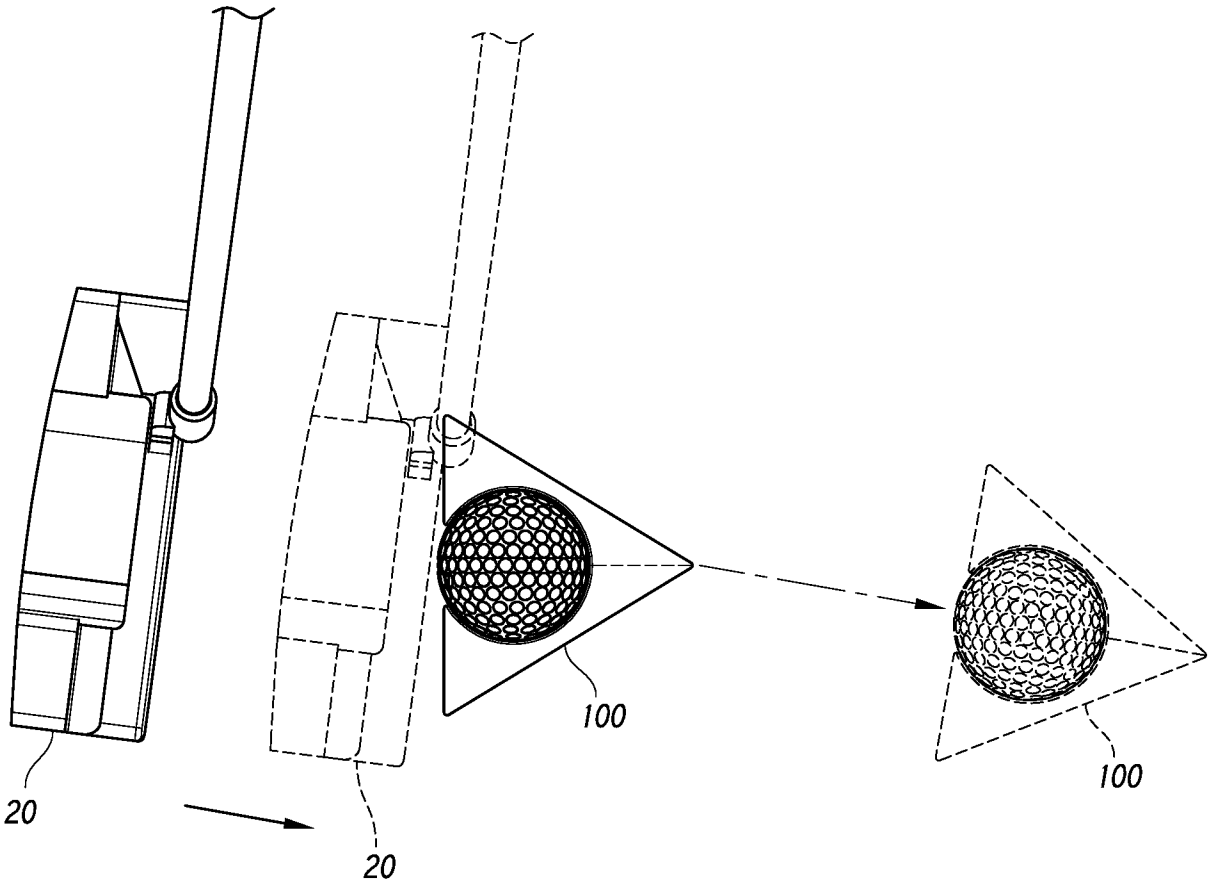
FIG. 4 is a top view of the exemplary preferred first putting trainer of FIG. 2, with the golf club contacting with the putting trainer on the left side of the obstacle such that the putting trainer travels in a rightward direction, which is not the preferred direction.
Figure 5:
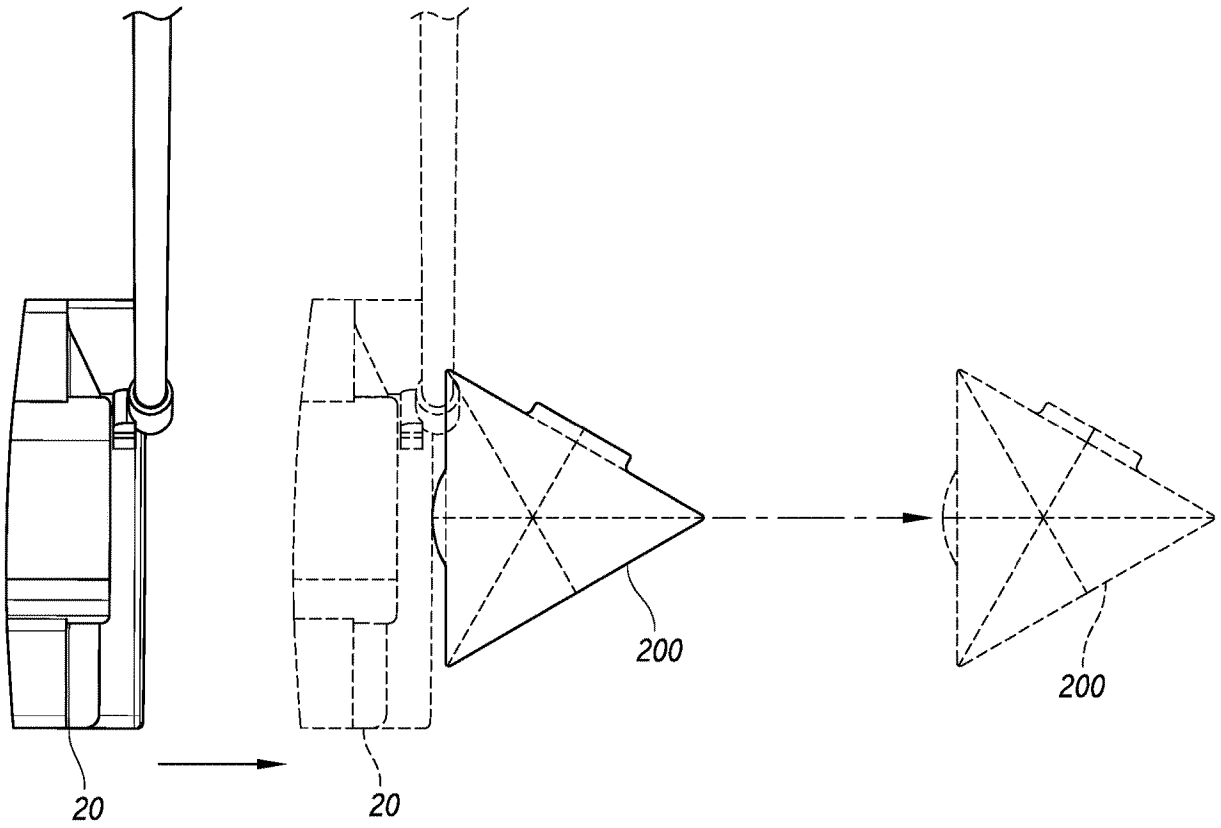
FIG. 5 is a top view of an exemplary preferred second putting trainer positioned in front of a golf club, the golf club contacting squarely with a curved protrusion obstacle of a first side of the putting trainer, the square contact causing the putting trainer to travel in a preferred forward direction towards the target.
Figure 6:
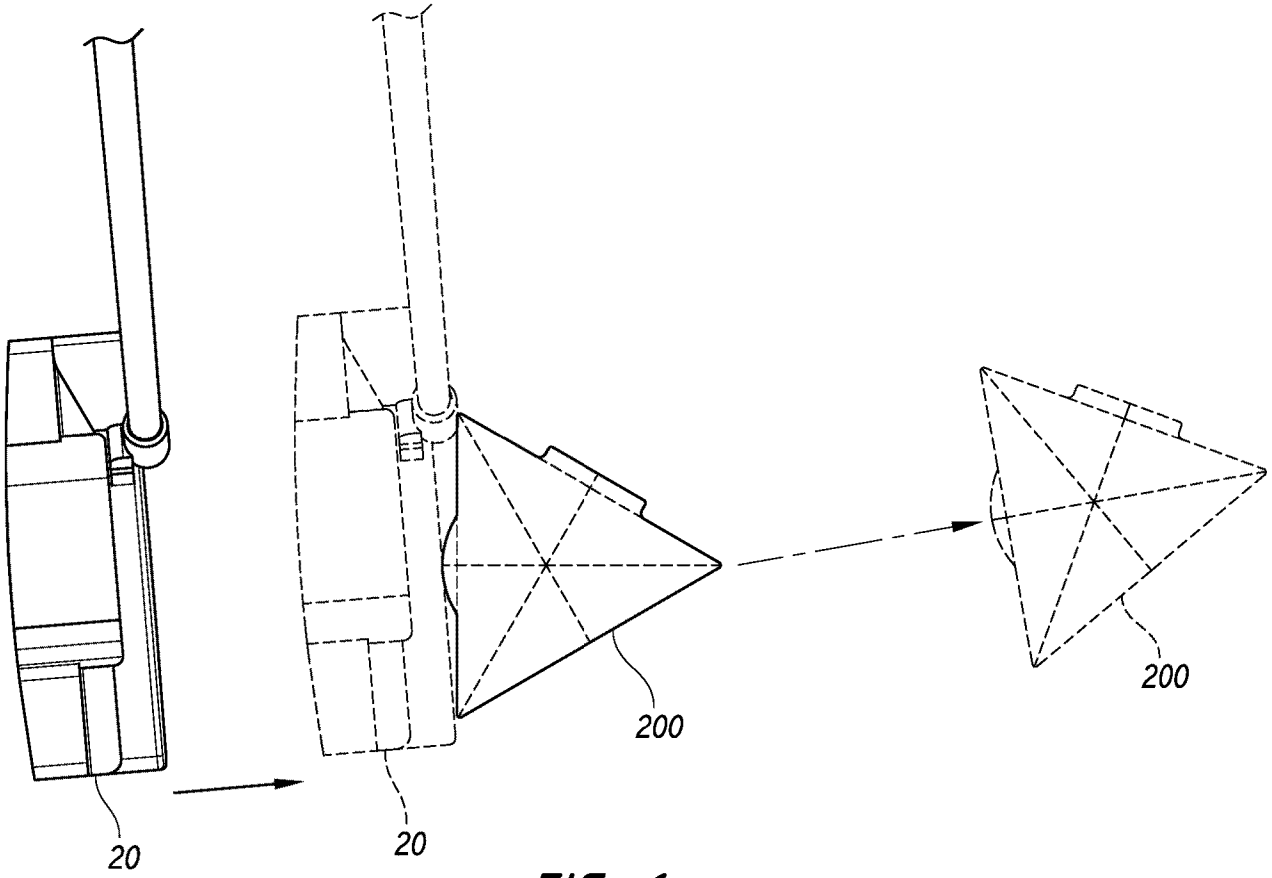
FIG. 6 is a top view of the exemplary preferred second putting trainer of FIG. 5, with a golf club contacting with the putting trainer on the right side of the curved protrusion obstacle such that the putting trainer travels in a leftward direction, which is not the preferred direction.
Figure 7:
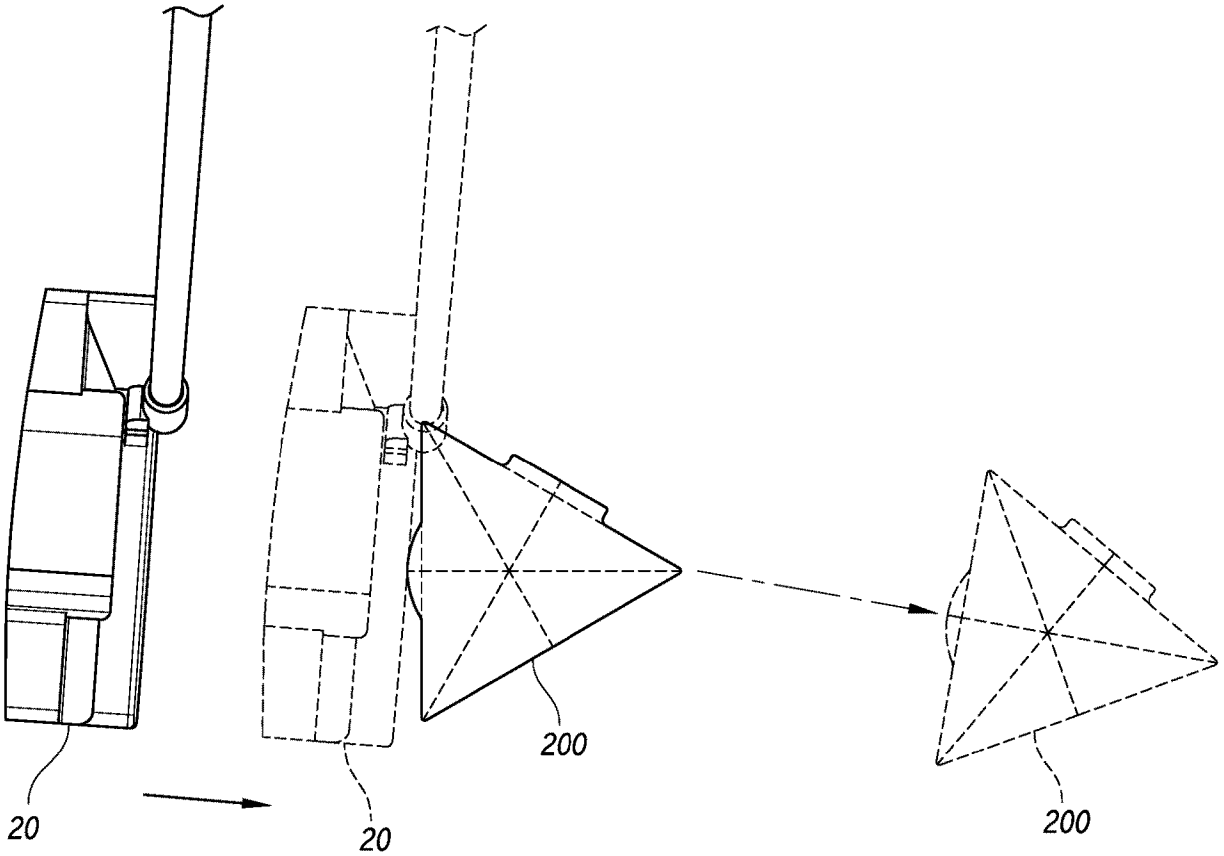
FIG. 7 is a top view of the exemplary preferred second putting trainer of FIG. 5, with a golf club contacting with the putting trainer on the left side of the curved protrusion obstacle such that the putting trainer travels in a rightward direction, which is not the preferred direction.
Figure 8:
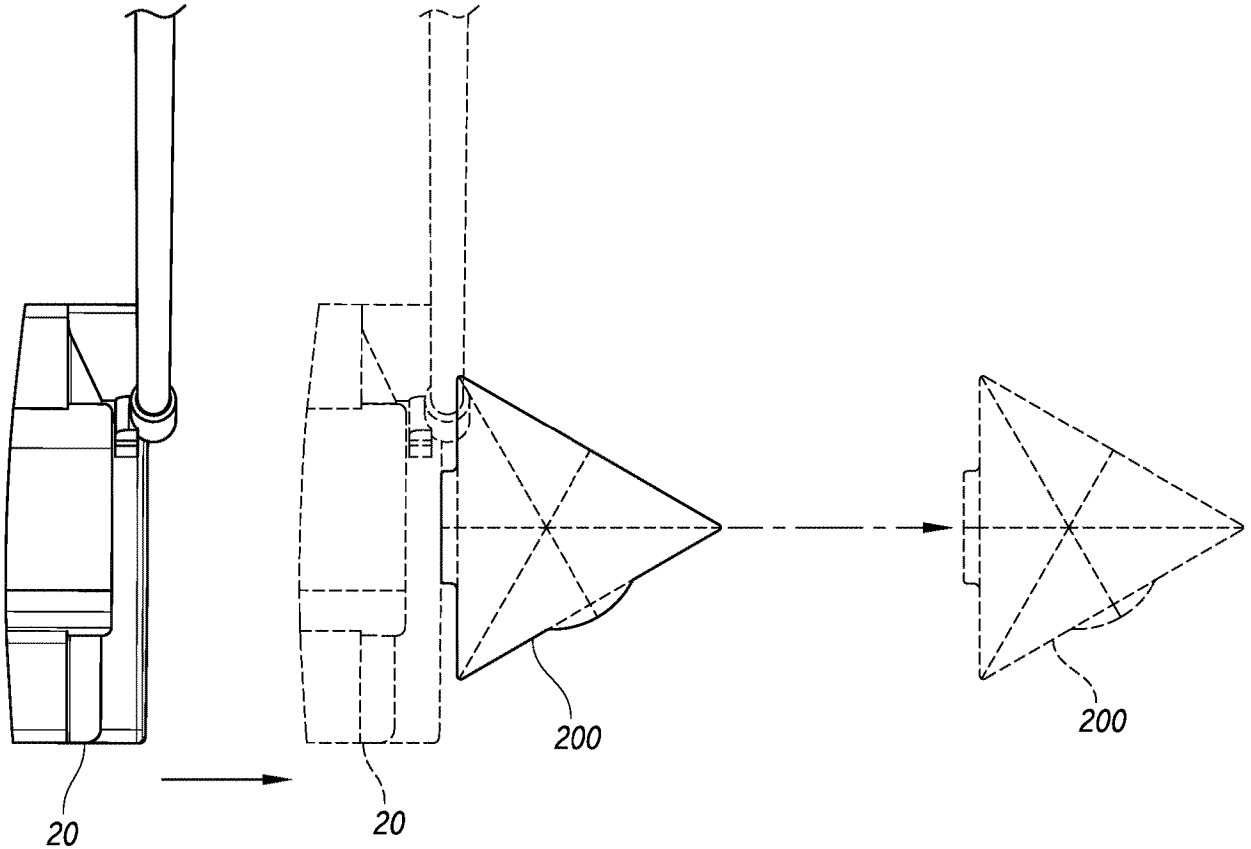
FIG. 8 is a top view of the exemplary preferred second putting trainer positioned in front of a golf club, the golf club contacting squarely with an offset flat obstacle of a second side of the putting trainer, the square contact causing the putting trainer to travel in a preferred forward direction towards the target.
Figure 9:
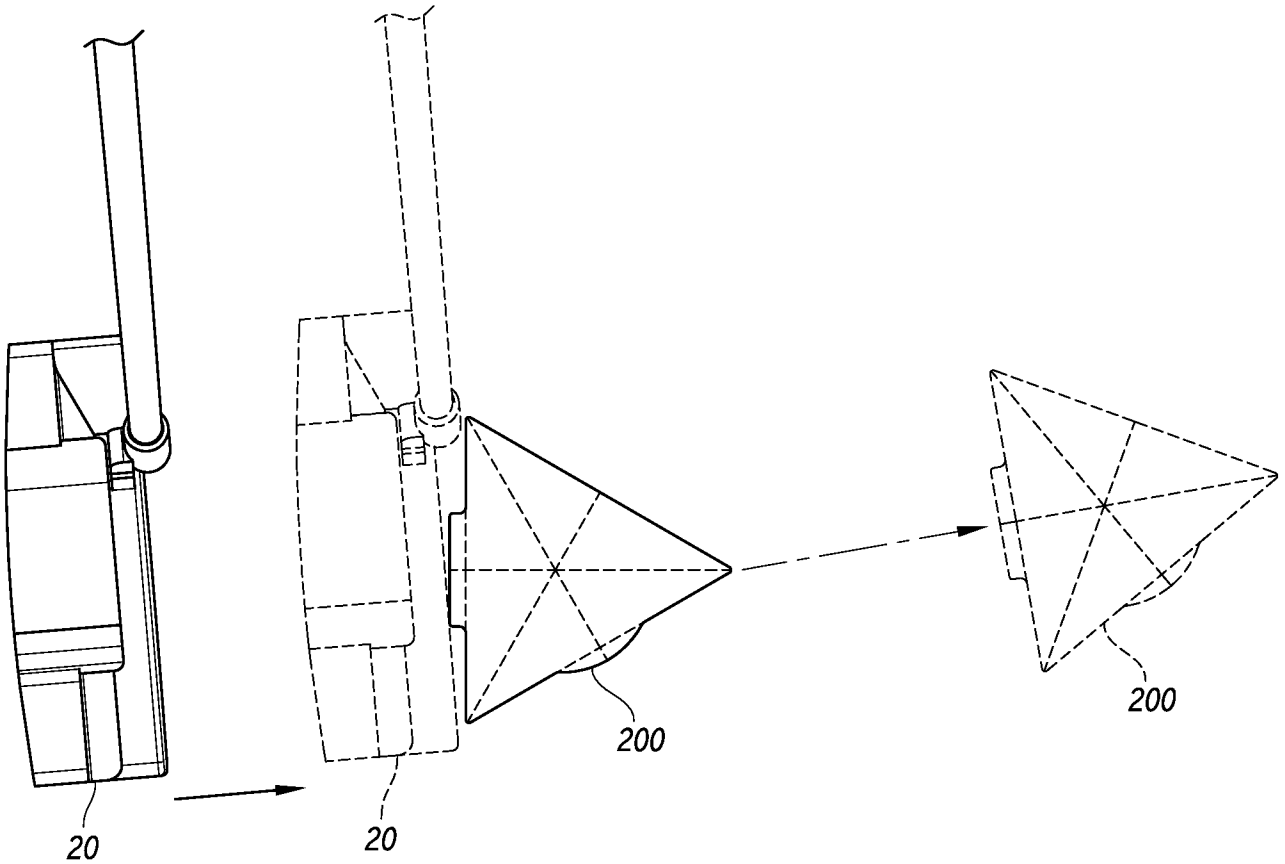
FIG. 9 is a top view of the exemplary preferred second putting trainer of FIG. 8, with a golf club contacting with the putting trainer on the right side of the offset flat obstacle such that the putting trainer travels in a leftward direction, which is not the preferred direction.
Figure 10:
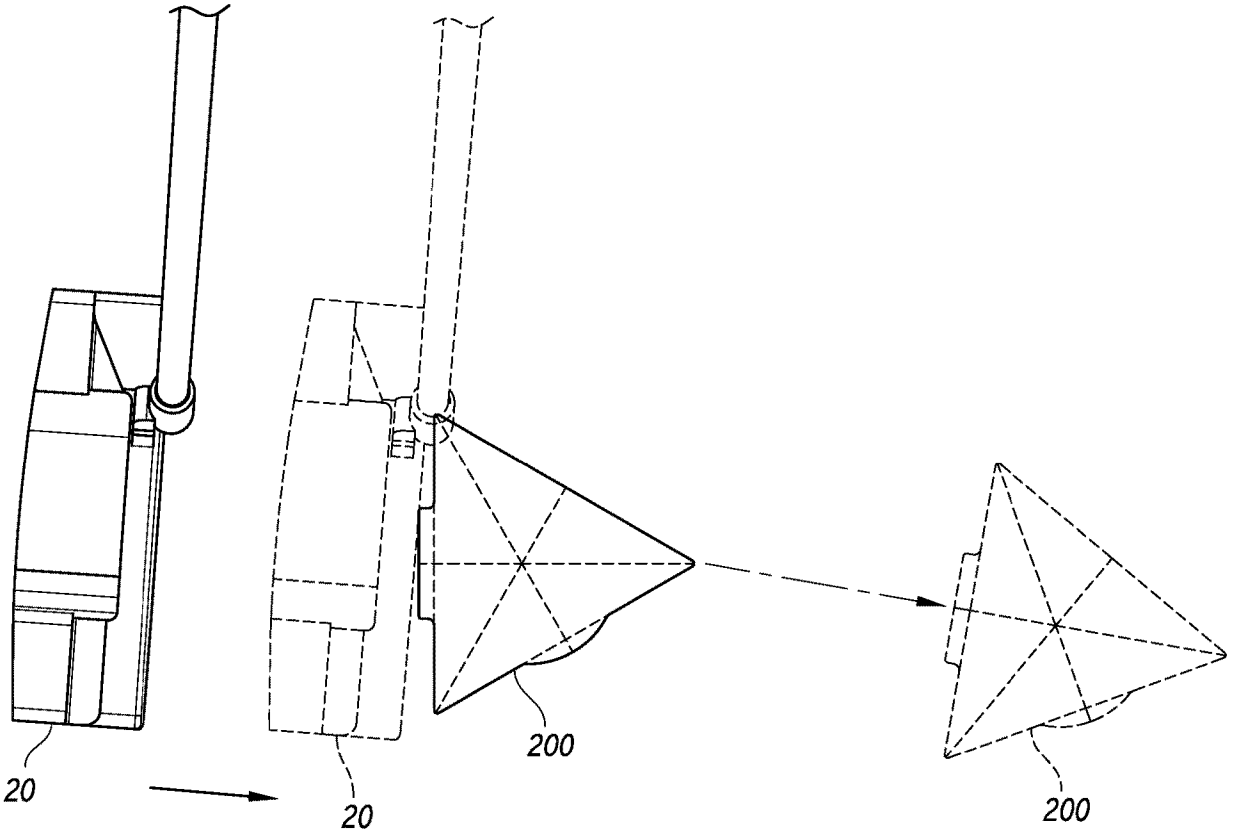
FIG. 10 is a top view of the exemplary preferred second putting trainer of FIG. 8, with a golf club contacting with the putting trainer on the left side of the offset flat obstacle such that the putting trainer travels in a rightward direction, which is not the preferred direction.
Figure 11:
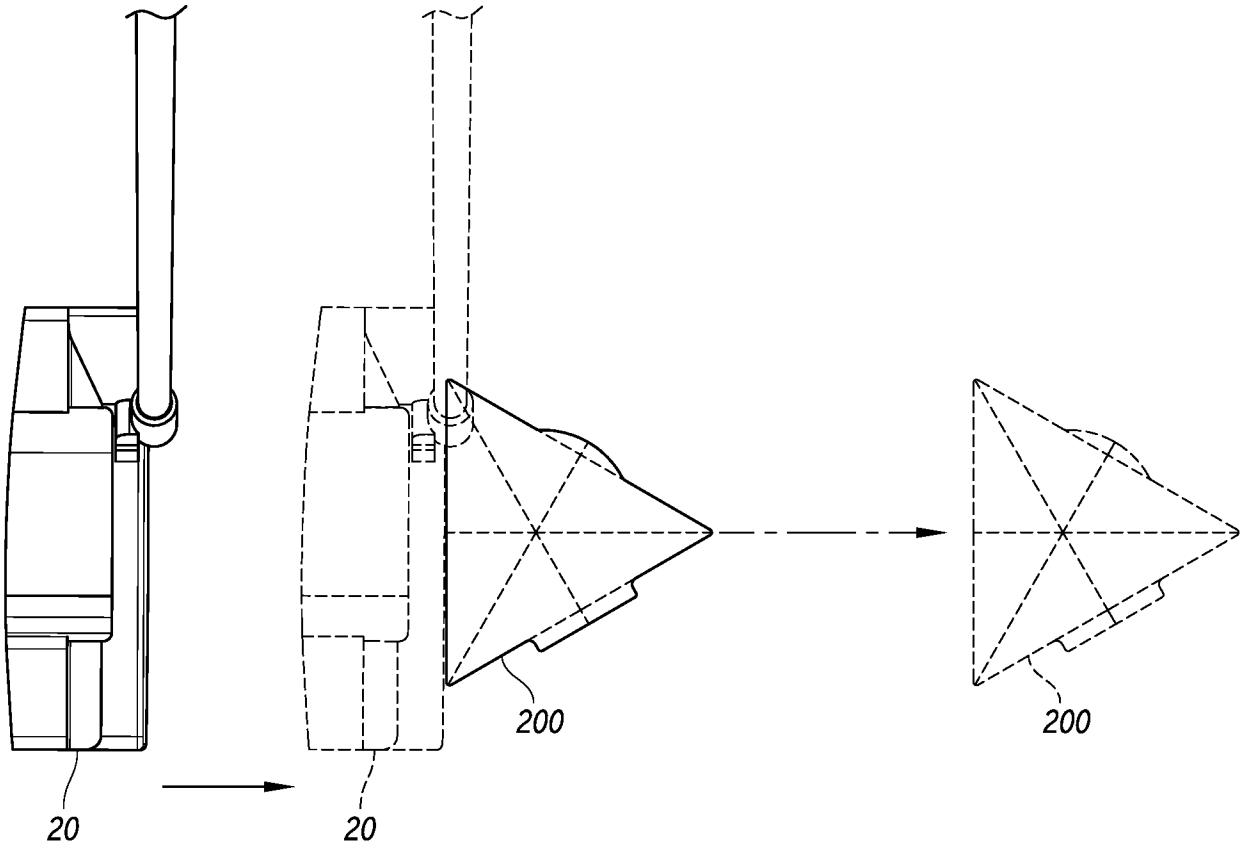
FIG. 11 is a top view of the exemplary preferred second putting trainer positioned in front of a golf club, the golf club contacting squarely with a coextensive obstacle of a third side of the putting trainer, the square contact causing the putting trainer to travel in a preferred forward direction towards the target.

Described herein is a putting trainer that may be used to practice golf. The user 10 uses a golf club 20 to contact the putting trainer 30 (the generic "putting trainer 30" includes each of the described putting trainers 100, 200, 300, 400, 500, and 600) as shown in FIG. 1. If the contact is "square" (correctly hit), the contact sends the putting trainer traveling in the preferred forward direction towards a target 50 at the end of a putting surface 40. If the contact is not square (e.g. to the left or the right), the putting trainer travels at an undesired angle. Using an exemplary putting trainer 100 with a single obstacle, FIG. 2 shows square contact and the results thereof and FIGS. 3 and 4 show angled (incorrect) contact and the results thereof. Using an exemplary putting trainer 200 with three obstacles, FIGS. 5, 8, and 11 show square contact and the results thereof and FIGS. 6-7, 9-10, and 12-13 show angled (incorrect) contact and the results thereof.

Exemplary putting trainers may be better understood with reference to the drawings, but these putting trainers are not intended to be of a limiting nature. The same reference numbers will be used throughout the drawings and description in this document to refer to the same or like parts. The shown shapes and relative dimensions are preferred, but are not meant to be limiting unless specifically claimed, in which case they may limit the scope of that particular claim.

Definitions

Before describing the putting trainers 30 and the figures, some of the terminology should be clarified. Please note that the terms and phrases may have additional definitions and/or examples throughout the specification. Where otherwise not specifically defined, words, phrases, and acronyms are given their ordinary meaning in the art. The following paragraphs provide some of the definitions for terms and phrases used herein.

The phrase "golf club" is generally meant to describe a device that is swung by a user to contact a predetermined object (e.g. a golf ball). In most cases, the device is a golf club including, but not limited to, putters, irons, and woods. The device may also be a specifically made training device that may be used in place of a traditional golf club. Devices for other sports or other purposes may also be used. For example, the device may be a hockey stick that is swung by a user to contact a hockey puck.

The phrase "putting surface" is generally meant to describe the surface upon which the putting trainer 30 will be used. The putting surface 40 is preferably a smooth surface (e.g. linoleum floors, wood floors, cement floors). Depending on the shape of the putting trainer 30, the lower surface of the putting trainer 30, the use of wheels or casters, and/or the material used to make the putting trainer 30 (and/or the legs thereof), the surface may not be perfectly smooth. The putting surface 40 may be a surface that just happens to be present (e.g. the kitchen floor), or a specially designed surface (e.g. the putting surface 40 shown in FIG. 1).

The term "travel" (and variations thereof) is generally meant to describe the movement of the putting trainer 30. The traveling may be sliding, gliding, skidding, or other type of movement. If the putting trainer 30 has wheels or castors, the traveling may be rolling. Although traveling is important, the putting trainer 30 should not travel too far or it would partially defeat its purpose of being able to show a trajectory, but not have to be chased after every practice contact. A regular golf ball would travel too much on a smooth surface necessitating the user to run after the ball each time he practiced a putt. The ideal traveling distance would depend on the intended use. For example, if used with a specially adapted putting surface 40, the ideal traveling distance would be the distance to the target 50. If the putting trainer 30 were used on a hardwood floor, the ideal traveling distance might be the distance a golfer could reach in a few steps (including using the golf club 20 for reach).

The term "target" is generally meant to describe a visual representation toward which the user is aiming the golf ball. Even if the target 50 is meant to represent a "cup" (golf hole), it does not have to be a hole. The target 50 may have a back stop or other structure that blocks the progression of the putting trainer 30. The target may be a target that just happens to be present (e.g. a pattern on the floor or a cup turned on its side), or a specially designed target (e.g. the target 50 shown in FIG. 1).

The term "contact" (and variations thereof) is generally meant to describe the connecting or interacting of the golf club and the putting trainer 30. Contacting may be putting, tapping, hitting, pushing, bumping, or other type of connection or interaction. "Square contact" would be made if the head of the golf club is perpendicular to the imaginary line between the center of the golf ball and the center of the target 50. If the contact is "square" (correctly hit), the contact sends the putting trainer 30 traveling in the preferred forward direction (straight trajectory) towards a target 50 at the end of a putting surface 40. If the contact is not square (e.g. at an angle to the left or the right), the putting trainer 30 travels at an undesired angle. "Not square" can also be referred to as "off square" or "off center" contact.

The term "obstacle," as used herein, is meant to convey a feature on the side of the putting trainer 30. The type and size of the obstacle determines the difficulty of the putting trainer 30. In some cases, the obstacle of a putting trainer 100 is a portion of a real golf ball (e.g. FIGS. 14-20). In some cases, there are different types or shapes of obstacles on the putting trainer 200 (e.g. FIGS. 21-28). In some cases, there are different sizes of obstacles on the putting trainer 300 (e.g. FIGS. 29-36). In some cases, there is only a flat obstacle (a flat side) on the putting trainer 400 (e.g. FIGS. 37-43).

The terms "protrude" and "protrusion" (and variations on these terms), as used herein, are meant to convey the idea of "extending beyond." In the case of the protruding or protrusion obstacles, the obstacles extend beyond the side with which the extension is associated. How far a protrusion obstacle extends beyond the side is the extension distance (or just distance).

The term "associated" is defined to mean integral or original, retrofitted, attached, connected (including functionally connected), positioned near, and/or accessible by.

It should be noted that relative terms are meant to help in the understanding of the technology and are not meant to limit the scope of the invention. Similarly, unless specifically stated otherwise, the terms "first," "second," and "third" are meant solely for purposes of designation and not for order or limitation. For example, the "first putting trainer" has no order relationship with the "fifth putting trainer." For example, first side of the putting trainer 30 has no order relationship with the second or third sides of the putting trainer 30.

It should be noted that some terms used in this specification are meant to be relative. For example, the term "top" (used herein in relation to the top surface of the putting trainer 30) is meant to be relative to the term "bottom" (used herein in relation to the bottom surface of the putting trainer 30). The term "front" is meant to be relative to the term "back," and the term "side" is meant to describe a "face" or "view" that connects the "front" and the "back." If the device was rotated, the terms would change accordingly. Rotation of the putting trainer 30 that changed the designation might change the terminology, but not the concept.

The terms "may," "might," "can," and "could" are used to indicate alternatives and optional features and only should be construed as a limitation if specifically included in the claims. For example, the phrase "a single body may be used with different adapters or the cavity may be adaptable" indicates that it is optional to use adapters and it is optional to have an adaptable cavity. It should be noted that the various components, features, structure, or embodiments thereof are all "preferred" whether or not it is specifically indicated. Claims not including a specific limitation should not be construed to include that limitation.

Unless specifically stated otherwise, the term "exemplary" is meant to indicate an example, representative, and/or illustration of a type. The term "exemplary" does not necessarily mean the best or most desired of the type. For example, "exemplary suitable materials" are just a few possible examples of the materials from which the putting trainer 30 may be constructed, but other suitable materials could be just as desirable.

It should be noted that, unless otherwise specified, the term "or" is used in its nonexclusive form (e.g. "A or B" includes A, B, A and B, or any combination thereof, but it would not have to include all of these possibilities). It should be noted that, unless otherwise specified, "and/or" is used similarly (e.g. "A and/or B" includes A, B, A and B, or any combination thereof, but it would not have to include all of these possibilities). It should be noted that, unless otherwise specified, the terms "includes" and "has" mean "comprises" (e.g. a device that includes, has, contains, or comprises A and B, but optionally may contain C or additional components other than A and B). It should be noted that, unless otherwise specified, the singular forms "a," "an," and "the" refer to one or more than one, unless the context clearly dictates otherwise.

First Putting Trainer

Figure 44:
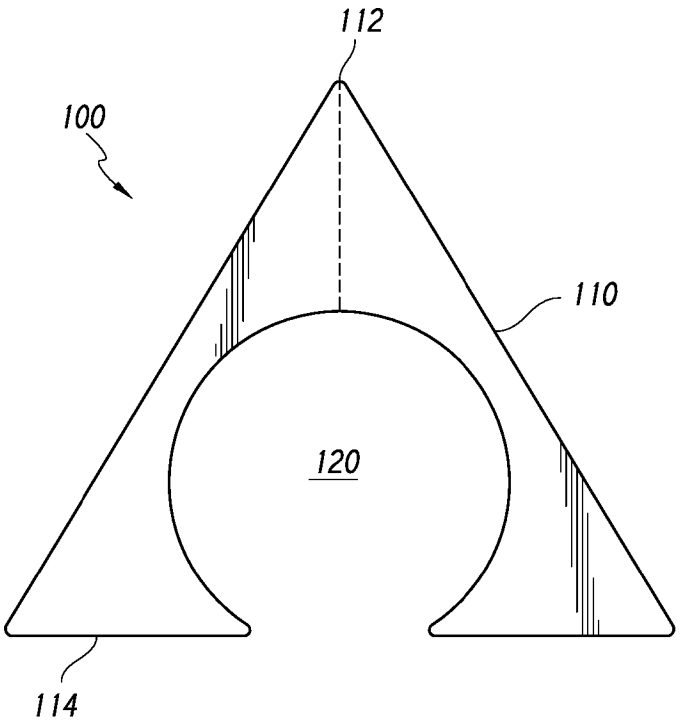
FIG. 44 is a top view of the exemplary preferred first putting trainer without a golf ball shown therein.

FIGS. 14-20 show an exemplary preferred first putting trainer 100. The putting trainer 100 is shown as having a generally triangular body 110 (e.g. having three sides) with a cavity 120 defined therein. The cavity 120 preferably has a diameter sufficient to hold a golf ball 130 at least partially therein. (FIG. 44 is a top view of the exemplary preferred first putting trainer 100 without a golf ball 130 shown therein.) The body 100 may have at least one optional sight line 140 on the upper surface for lining up with the target 50.

As set forth, the putting trainer 100 is shown as having a generally triangular body 110. The shown putting trainer 100 has a front 112 (which is shown as a point or vertex), a back 114 (which is also referred to as a back side 114), and two sides 116 and 118 connecting the front 112 and the back 114. This exemplary putting trainer 100 has only a single obstacle which, in this case is a portion of a golf ball 130 that protrudes from the back side 114.

As set forth, a cavity 120 is defined in the triangular body 110 of the putting trainer 100. The cavity 120 has a diameter just slightly smaller than the diameter of the golf ball 130 (which may be a standard golf ball 130 to allow the golfer to select a favorite golf ball) at a point of the body height to hold the golf ball 130 at the appropriate height. Depending on the thickness of the triangular body 110, the cavity can be cylindrical or have walls that are angled slightly inward (i.e. like part of a conical cavity). In one preferred putting trainer 100, the golf ball 130 sits so that its bottom is at or slightly above the level of the bottom surface of the triangular body 110. The shown cavity is a through cavity, but there could be a "floor" (upon which the golf ball 130 could sit). Unlike some of the known prior art devices that allow a golf ball to escape through the bottom of a cavity to continue on, the cavity 120 is meant to contain the golf ball 130 and not allow it to escape.

Figure 17:
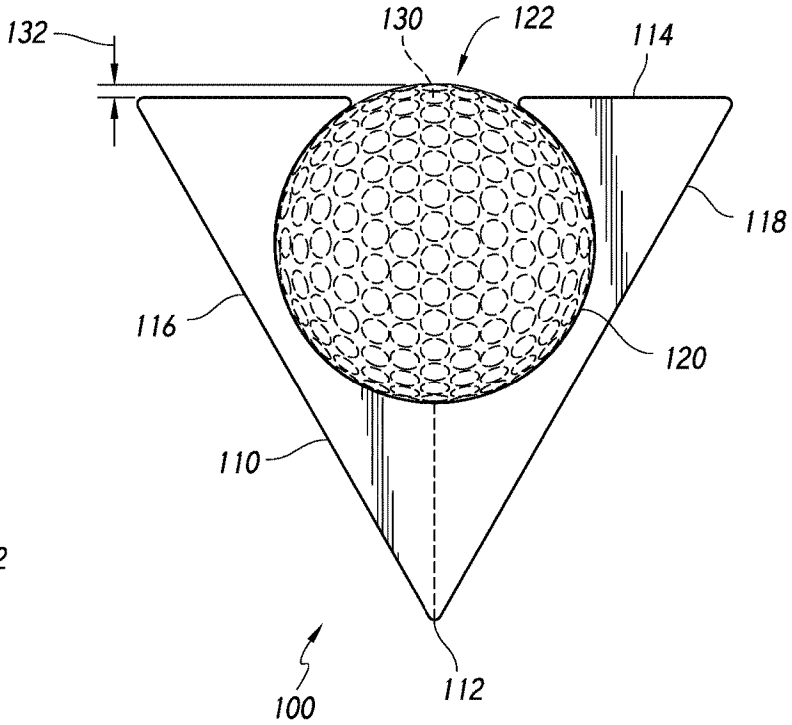
FIG. 17 is a bottom view of the exemplary preferred first putting trainer of FIG. 14.
Figure 16:
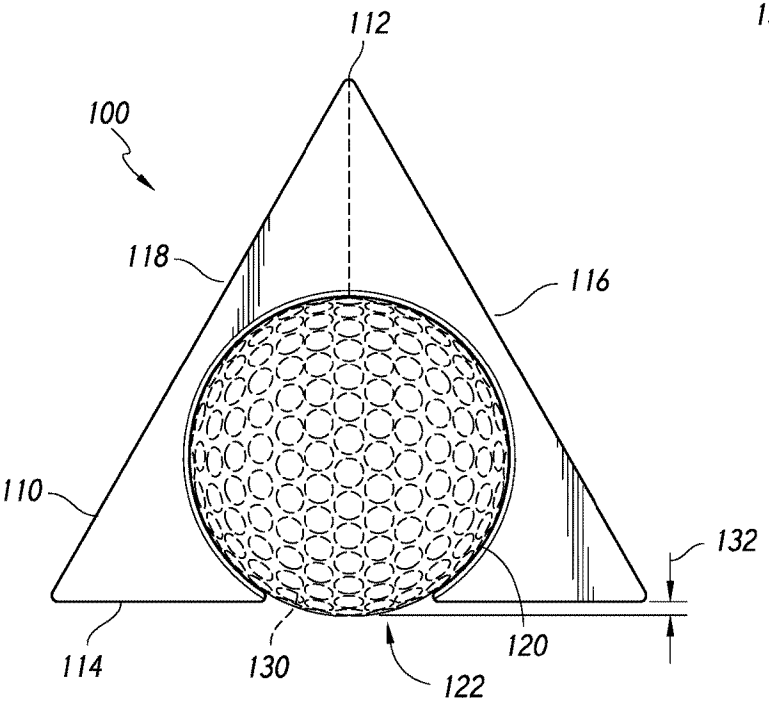
FIG. 16 is a top view of the exemplary preferred first putting trainer of FIG. 14.
Figure 19:
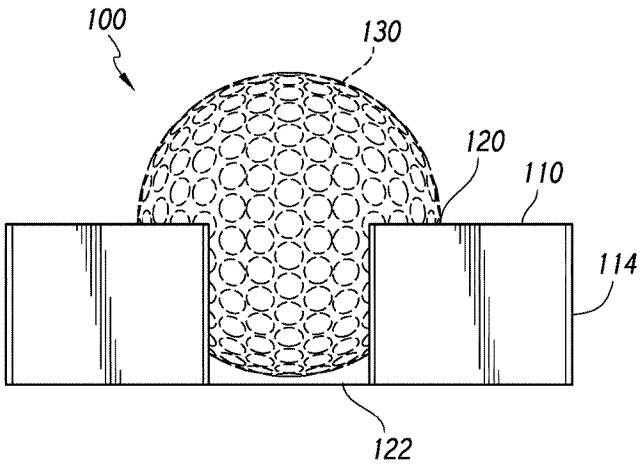
FIG. 19 is a back view of the exemplary preferred first putting trainer of FIG. 14.
Figure 18:
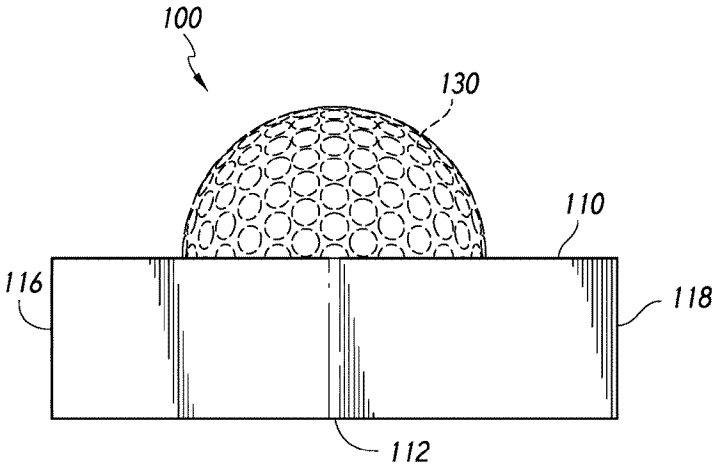
FIG. 18 is a front view of the exemplary preferred first putting trainer of FIG. 14.
Figure 20:
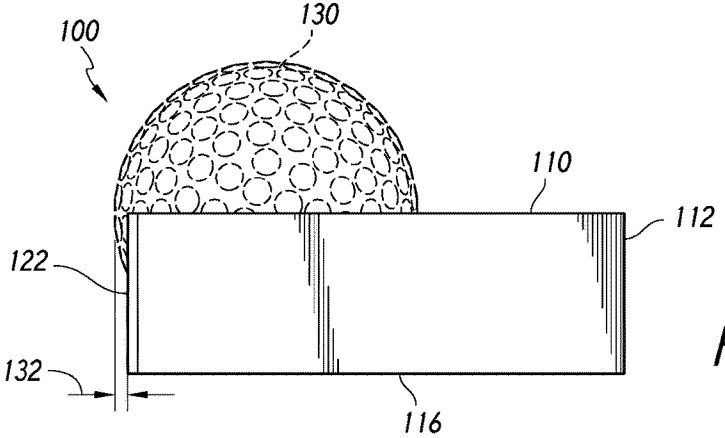
FIG. 20 is a first side view of the exemplary preferred first putting trainer of FIG. 14, the second side view being a mirror image thereof.
Figure 22:
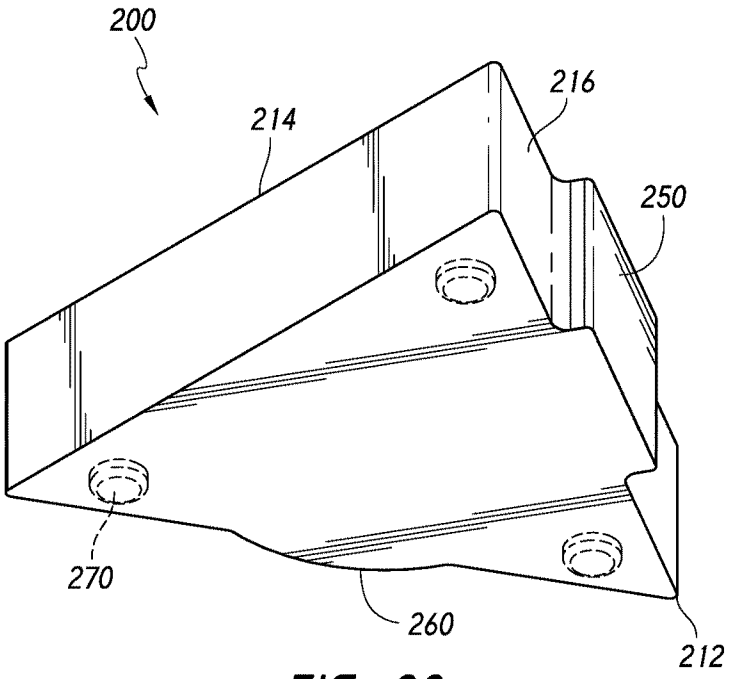
FIG. 22 is a bottom perspective view of the exemplary preferred second putting trainer of FIG. 21.
Figure 21:
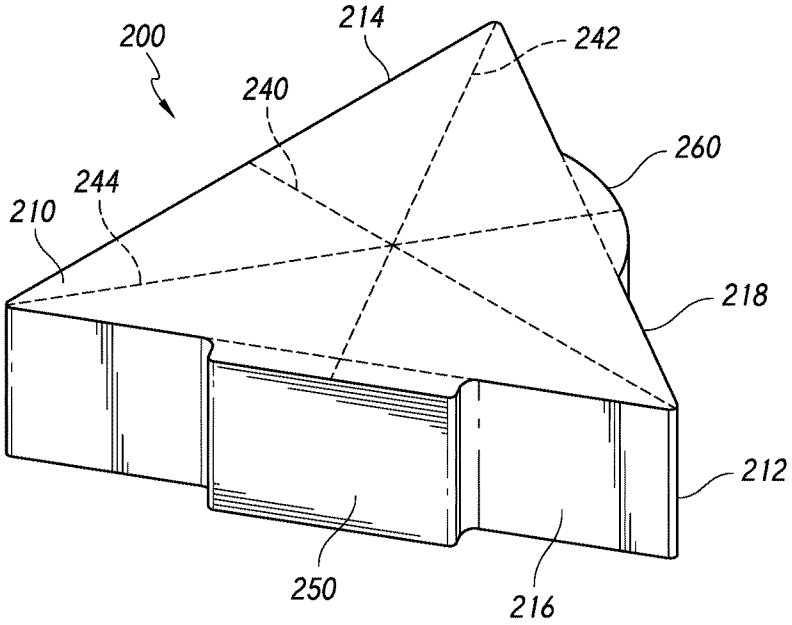
FIG. 21 is a top perspective view of an exemplary preferred second putting trainer, the putting trainer shown as generally triangular, each side of the triangular body having an obstacle (shown as a curved protrusion obstacle, an offset flat obstacle, and a coextensive obstacle), the triangular body having optional sight lines on the upper surface for lining up with the target.
Figure 24:
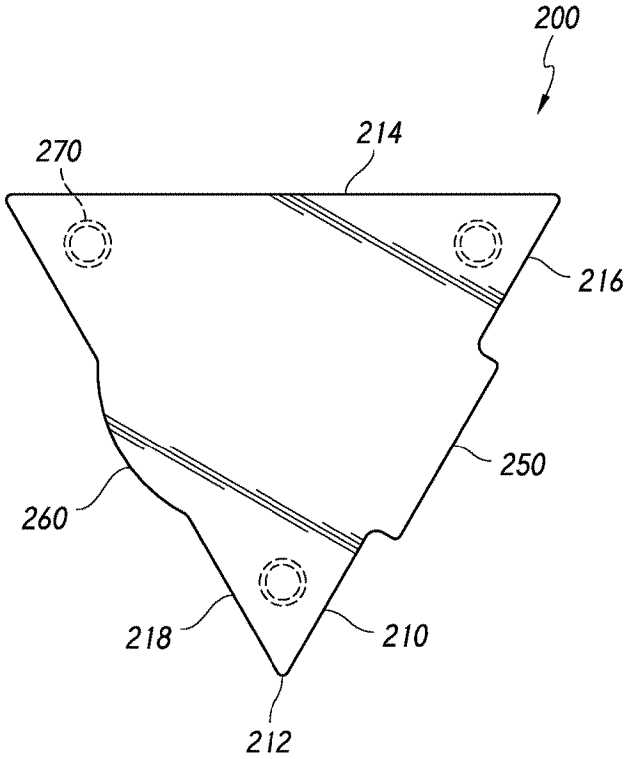
FIG. 24 is a bottom view of the exemplary preferred second putting trainer of FIG. 21.
Figure 23:
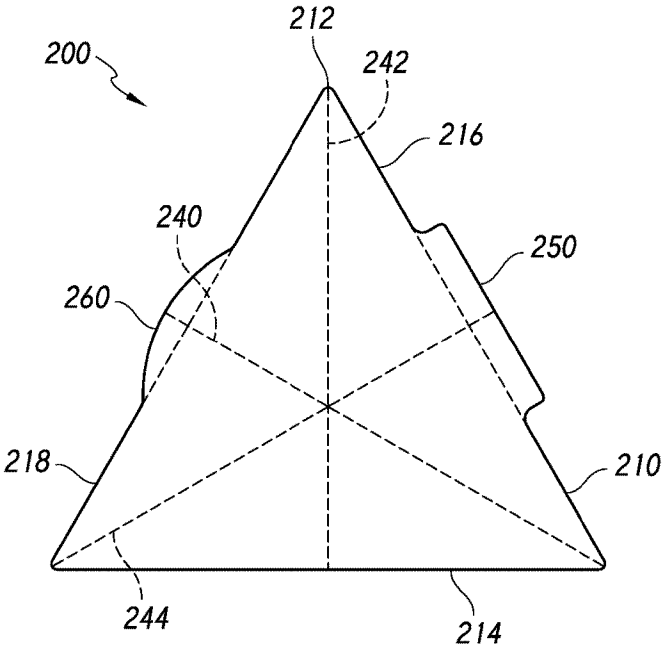
FIG. 23 is a top view of the exemplary preferred second putting trainer of FIG. 21.
Figure 26:
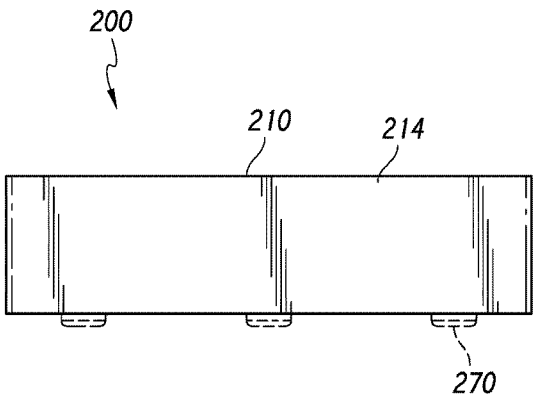
FIG. 26 is a back view of the exemplary preferred second putting trainer of FIG. 21.
Figure 28:
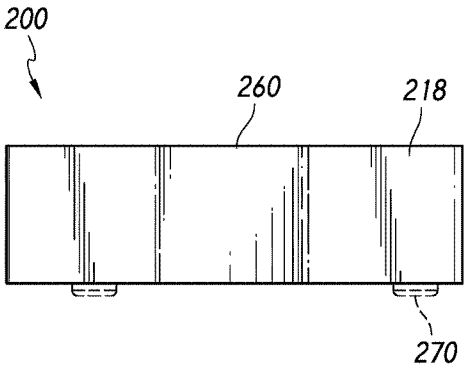
FIG. 28 is a second side view of the exemplary preferred second putting trainer of FIG. 21, the shown side having a curved protrusion obstacle.
Figure 25:
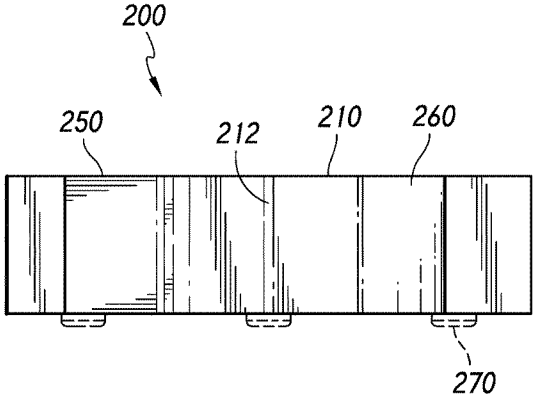
FIG. 25 is a front view of the exemplary preferred second putting trainer of FIG. 21.
Figure 27:
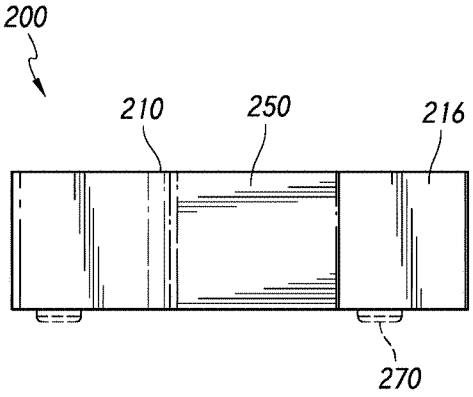
FIG. 27 is a first side view of the exemplary preferred second putting trainer of FIG. 21, the shown side having an offset flat obstacle.
Figure 30:
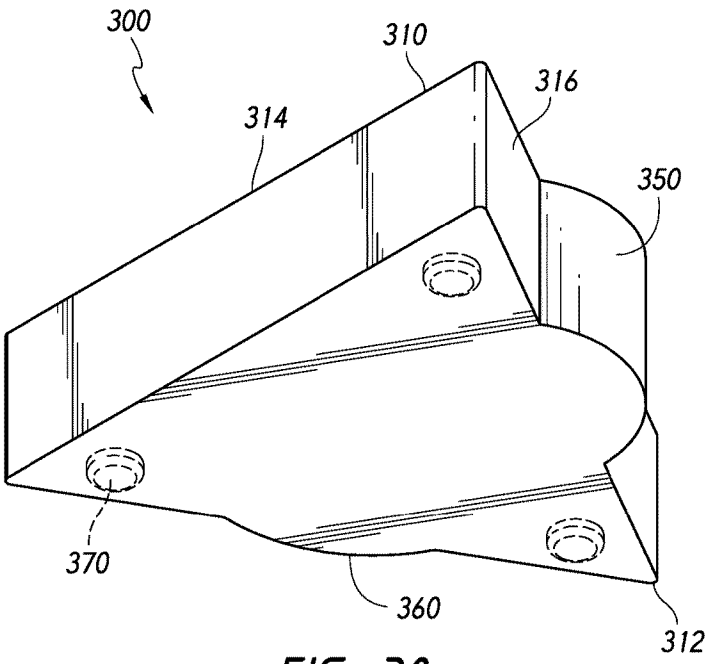
FIG. 30 is a bottom perspective view of the exemplary preferred third putting trainer of FIG. 29.
Figure 29:
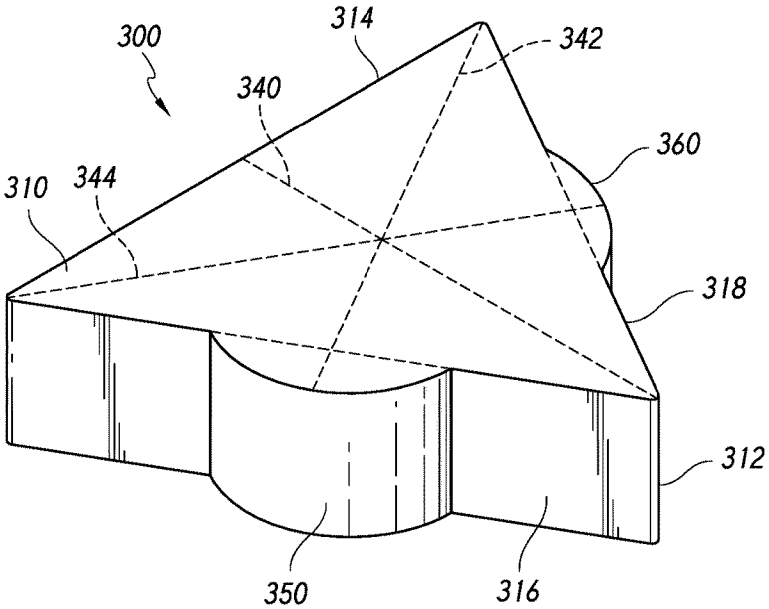
FIG. 29 is a top perspective view of an exemplary preferred third putting trainer, the putting trainer shown as generally triangular, each side of the triangular body having an obstacle (shown as a small curved protrusion obstacle, a large curved protrusion, and a coextensive obstacle), the triangular body having optional sight lines on the upper surface for lining up with the target.
Figure 32:
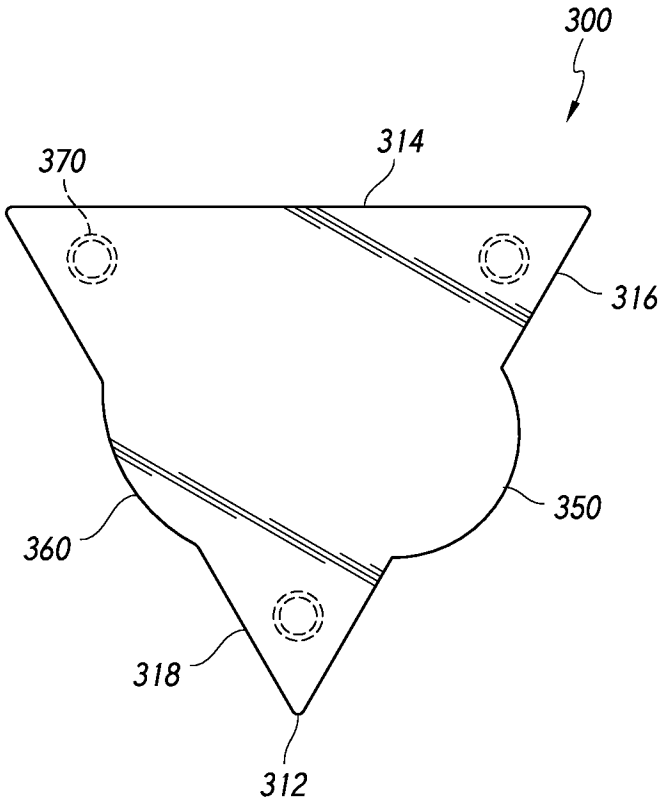
FIG. 32 is a bottom view of the exemplary preferred third putting trainer of FIG. 29.
Figure 31:
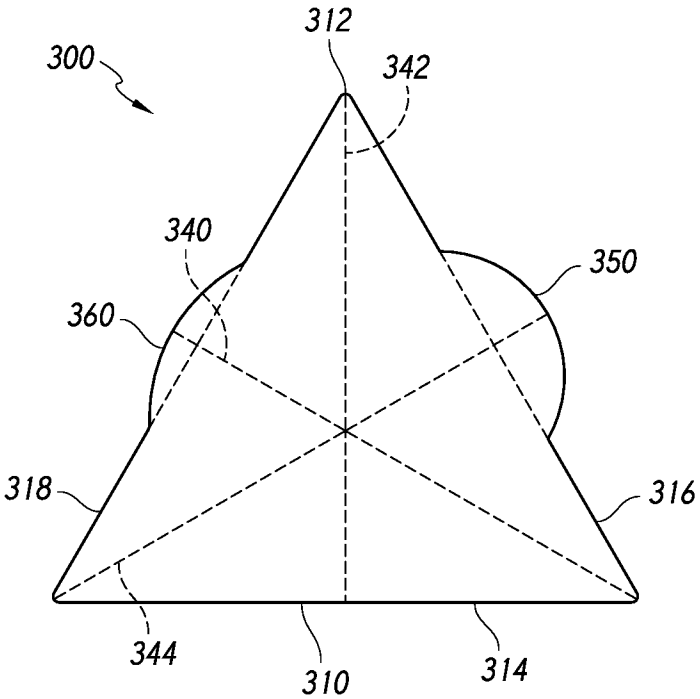
FIG. 31 is a top view of the exemplary preferred third putting trainer of FIG. 29.
Figure 33:
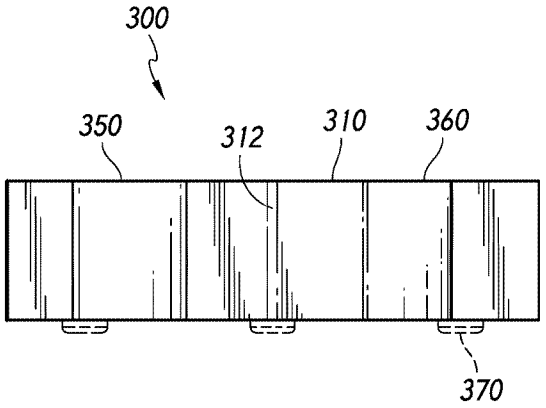
FIG. 33 is a front view of the exemplary preferred third putting trainer of FIG. 29.
Figure 34:
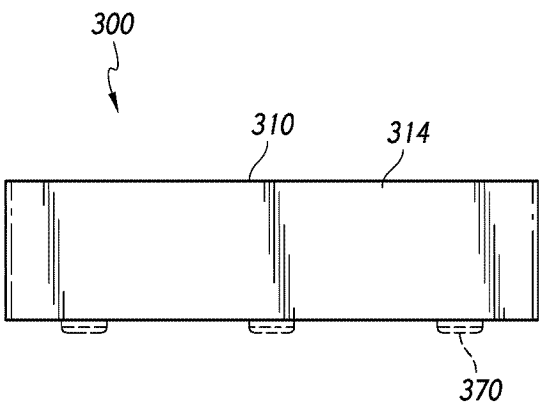
FIG. 34 is a back view of the exemplary preferred third putting trainer of FIG. 29.
Figure 35:
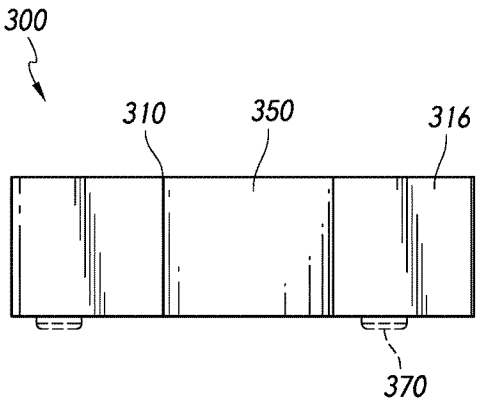
FIG. 35 is a first side view of the exemplary preferred third putting trainer of FIG. 29, the shown side having a large curved protrusion obstacle.
Figure 36:
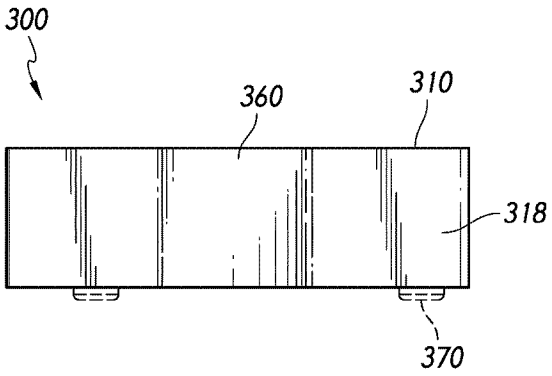
FIG. 36 is a second side view of the exemplary preferred third putting trainer of FIG. 29, the shown side having a small curved protrusion obstacle.
Figure 38:
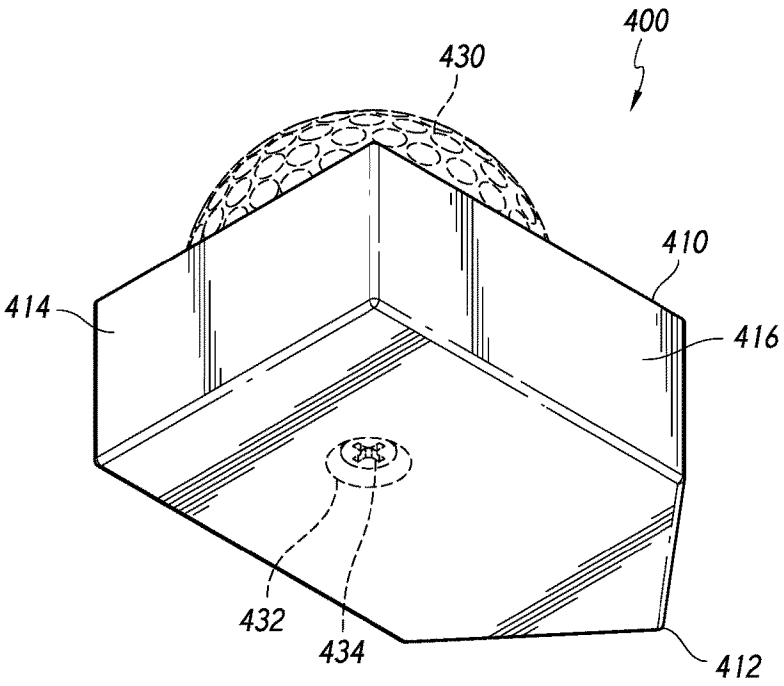
FIG. 38 is a bottom perspective view of the exemplary preferred fourth putting trainer of FIG. 37.
Figure 37:
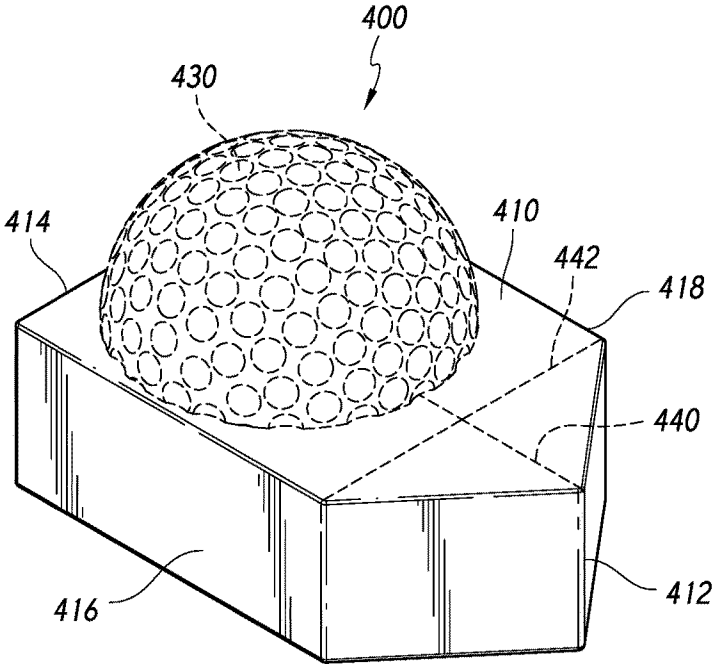
FIG. 37 is a top perspective view of an exemplary preferred fourth putting trainer, the putting trainer having an associated mock golf ball (shown as a bolted on half of a golf ball), and the body having optional sight lines on the upper surface for lining up with the target.
Figure 40:
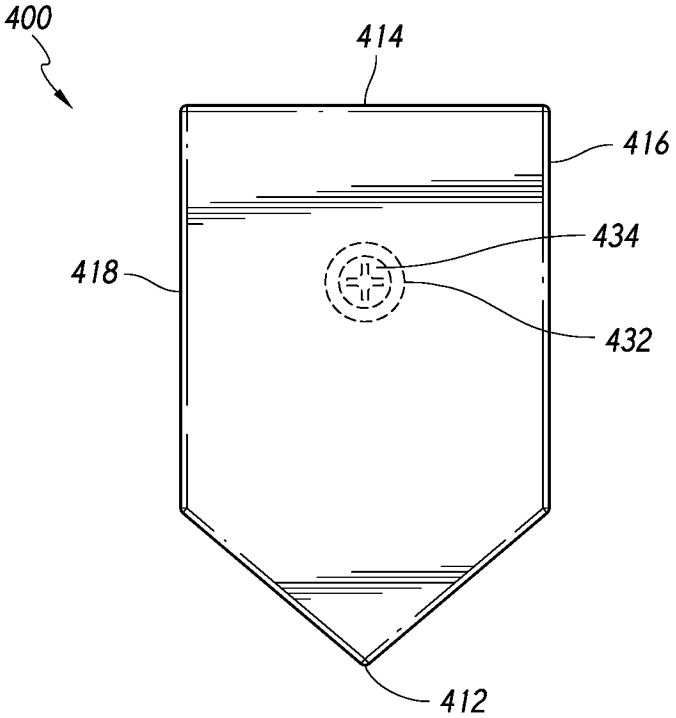
FIG. 40 is a bottom view of the exemplary preferred fourth putting trainer of FIG. 37.
Figure 39:
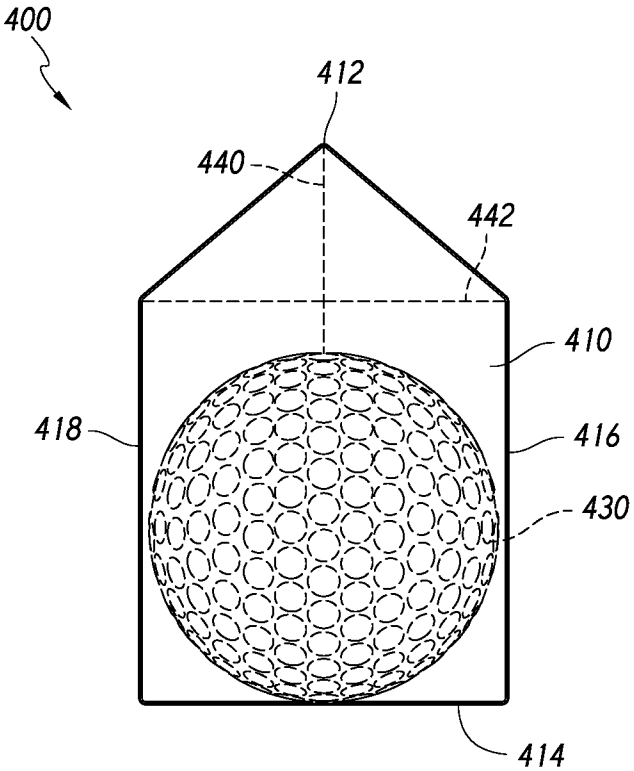
FIG. 39 is a top view of the exemplary preferred fourth putting trainer of FIG. 37.
Figure 42:
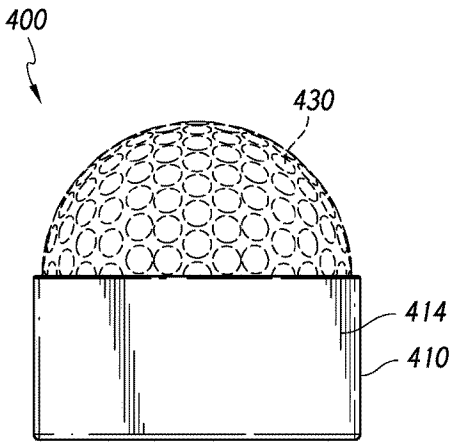
FIG. 42 is a back view of the exemplary preferred fourth putting trainer of FIG. 37.
Figure 41:
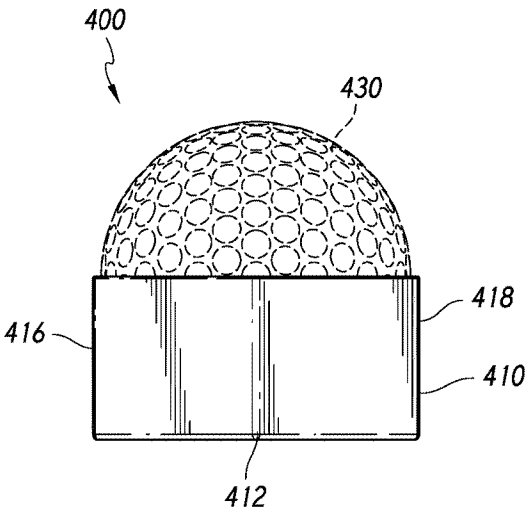
FIG. 41 is a front view of the exemplary preferred fourth putting trainer of FIG. 37.
Figure 43:
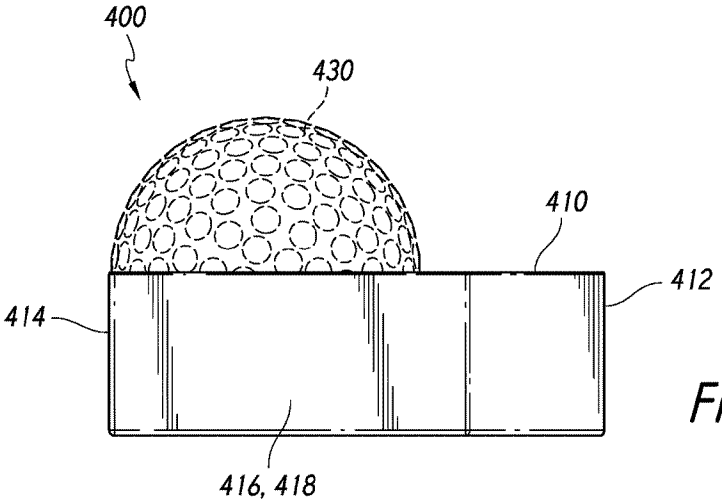
FIG. 43 is a first side view of the exemplary preferred fourth putting trainer of FIG. 37, the second side view being a mirror image thereof.

The obstacle of the shown putting trainer 100 is the projection of the golf ball 130 through the opening 122 created by the cavity 120 intersecting the back side 144 of the body 110. Put another way, a portion of the golf ball 130 extends through an opening 122 in the back side 114. As shown, the golf ball 130 extends (projects) through an opening 122 in the back side 114 a distance 132 (FIGS. 16 and 17). Alternative putting trainers could have larger extensions such that the distance 132 is larger.

Larger obstacles would generally be easier and smaller obstacles would generally be harder. Golfers might want to have several putting trainers 100, each with a different distance 132 so that they can use the devices to practice as a novice or amateur golfer (largest protrusion obstacle), a casual or social golfer (a middle-sized protrusion obstacle), a scratch golfer (a middle-sized protrusion obstacle that was smaller than the protrusion for the casual or social golfer), and a pro golfer (smallest protrusion obstacle or no protrusion obstacle (i.e. a coextensive obstacle)). As will be discussed in relation to the fifth putting trainer 500 and sixth putting trainer 600, a single body may be used with different adapters or the cavity may be adaptable.

The putting trainer 100 is shown as having at least one optional sight line 140 on the upper surface of the body 110. The sight line 140 may be used for lining up the putting trainer 100 with the target 50. Some golf balls have arrows, lines, or other indicators printed on their surfaces that indicate the best position to hit the ball and, if hit there, the direction that the ball will travel. These arrows, lines, or other indicators can be aligned with the sight line 140. These arrows, lines, or other indicators can also be used for positioning the proper part of the golf ball as the protrusion obstacle to be contacted.

It should be noted that, although not shown with feet, the putting trainer 100 may include feet (or similar structure). Although shown as an isosceles triangle, the body 110 may be an equilateral triangle. The body 110 may have alternative shapes such as a polygon, arrow, or chevron. As mentioned, there may be a "floor" that encloses the bottom of the cavity 120. Although the sides 116 and 118 are shown as flat, they could incorporate different types of obstacles including obstacles discussed elsewhere herein.

Second Putting Trainer

FIGS. 21-28 show an exemplary preferred second putting trainer 200. The putting trainer 200 is shown as having a generally triangular body 210 (e.g. having three sides). Each side 214, 216, 218 of the triangular body 210 may have an obstacle (shown as an offset flat obstacle 250, a curved protrusion obstacle 260, and a coextensive obstacle (the flat back surface 214)). The triangular body 210 may have optional sight lines 240, 242, 244 on the upper surface for lining up with the target 50.

The putting trainer 200 is shown as having a generally equilateral triangular body 210. The shown putting trainer 200 has a front 212 (which is shown as a point or vertex), a back 214 (which is also referred to as a back side 214), and two sides 216 and 218 connecting the front 212 and the back 214. As shown, there is an upper surface (shown as having optional sight lines 240, 242, 244) and a lower surface (shown as having feet 270 thereon).

The obstacles of the shown putting trainer 200 are each associated with a separate side 214, 216, 218 of the triangular body 210. The obstacles may be integral (molded or formed) with the putting trainer 200 or they may be removable and replaceable (not shown). If the obstacles are removable and replaceable, they could be attached using known structure including, but not limited to, friction (e.g. a perfect fit), mechanical means (e.g. screws or clamps), adhesives, magnets, or other attachment means known or yet to be discovered. If the obstacles are removable and replaceable, the user may be provided with obstacles of different shapes and sizes either to allow a progression of skill (e.g. obstacles for the golfer as he progresses from novice to pro) or to allow challenges for the golfer at his current level (e.g. different obstacles each designed for a casual golfer). The user may also be able to purchase replacement obstacles (e.g. as he improves or if the original obstacles are lost).

The shown putting trainer 200 has a first obstacle (shown as an offset flat obstacle 250) associated with a first side 216. The offset flat obstacle 250 is a type of protrusion obstacle in that it protrudes from the side 216. Although shown as an offset flat obstacle 250, the first obstacle may be an alternative obstacle including, but not limited to, a bigger or smaller offset flat obstacle, any-sized curved protrusion obstacle, or any other obstacle known or yet to be discovered (including other obstacles described herein).

The shown putting trainer 200 has a second obstacle (shown as a curved protrusion obstacle 260) associated with a second side 218. The curved protrusion obstacle 260 is a type of protrusion obstacle in that it protrudes from the side 218. Although shown as a curved protrusion obstacle 260, the second obstacle may be an alternative obstacle including, but not limited to, a bigger or smaller curved protrusion obstacle, any-sized offset flat obstacle, or any other obstacle known or yet to be discovered (including other obstacles described herein).

The shown putting trainer 200 has a flat back surface 214 which can be considered a third obstacle associated with the third or back side 214. The flat back surface 214 is also referred to as a coextensive obstacle. The flat back surface 214 is not a protrusion obstacle. Although the putting trainer 200 is shown with a flat back surface 214, alternative putting trainers could have a protrusion obstacle on the third side.

In addition to the described protrusion obstacles (e.g. curved protrusions or offset flat obstacles), other protrusion obstacles include, but are not limited to, triangular obstacles, pointed obstacles, or any other structure that protrudes from the majority of the face of the side. The position of the protrusion obstacles may also be adjusted (e.g. left or right, or higher or lower) depending on the skill to be learned by the golfer. The putting trainer 200 may have, for example, any combination of types of protrusion obstacles.

The putting trainer 200 is shown as having optional sight lines 240, 242, 244 on the upper surface of the body 210. There are three sight lines 240, 242, 244 shown, each one starting generally from a side 214, 216, 218 and extending generally to the opposite point or vertex. The sight lines 240, 242, 244 may be used for lining up the putting trainer 200 with the target 50. Some golf balls have arrows, lines, or other indicators printed on their surfaces that indicate the best position to hit the ball and, if hit there, the direction that the ball will travel. These arrows, lines, or other indicators can be aligned with the sight lines 240, 242, 244.

The putting trainer 200 is shown as having optional feet 270 on the bottom surface of the body 210. The feet 270 may be replaced with castors or wheels. If there are feet 270 associated with the lower surface of the body 210, then the bottom of the feet 270 become the lower surface that should be generally smooth for traveling.

Third Putting Trainer

FIGS. 30-36 show an exemplary preferred third putting trainer 300. The putting trainer 300 is shown as having a generally triangular body 310 (e.g. having three sides). Each side 314, 316, 318 of the triangular body 310 may have an obstacle (shown as a large curved protrusion obstacle 350, a small curved protrusion obstacle 360, and a coextensive obstacle (the flat back surface 314)). The triangular body 310 may have optional sight lines 340, 342, 344 on the upper surface for lining up with the target 50.

The putting trainer 300 is shown as having a generally equilateral triangular body 310. The shown putting trainer 300 has a front 312 (which is shown as a point or vertex), a back 314 (which is also referred to as a back side 314), and two sides 316 and 318 connecting the front 312 and the back 314. As shown, there is an upper surface (shown as having optional sight lines 340, 342, 344) and a lower surface (shown as having feet 370 thereon).

The obstacles of the shown putting trainer 300 are each associated with a separate side 314, 316, 318 of the triangular body 310. The obstacles may be integral (molded or formed) with the putting trainer 300 or they may be removable and replaceable (not shown). If the obstacles are removable and replaceable, they could be attached using known structure including, but not limited to, friction (e.g. a perfect fit), mechanical means (e.g. screws or clamps), adhesives, magnets or other attachment means known or yet to be discovered. If the obstacles are removable and replaceable, the user may be provided with obstacles of different shapes and sizes either to allow a progression of skill (e.g. obstacles for the golfer as he progresses from novice to pro)

or to allow challenges for the golfer at his current level (e.g. different obstacles each designed for a casual golfer). The user may also be able to purchase replacement obstacles (e.g. as he improves or if the original obstacles are lost).

The shown putting trainer 300 has a first obstacle (shown as a large curved protrusion 350) associated with a first side 316. The large curved protrusion 350 is a type of protrusion obstacle in that it protrudes from the side 316. Although shown as a large curved protrusion 350, the first obstacle may be an alternative obstacle including, but not limited to, a bigger or smaller curved protrusion obstacle, any-sized offset flat obstacle, a coextensive obstacle, any other obstacle known or yet to be discovered (including other obstacles described herein).

The shown putting trainer 300 has a second obstacle (shown as a small curved protrusion 360) associated with a second side 318. The small curved protrusion 360 is a type of protrusion obstacle in that it protrudes from the side 318. Although shown as a small curved protrusion 360, the second obstacle may be an alternative obstacle including, but not limited to, a bigger or smaller curved protrusion obstacle, any-sized offset flat obstacle, a coextensive obstacle, or any other obstacle known or yet to be discovered (including other obstacles described herein).

The shown putting trainer 300 has a flat back surface 314 which can be considered a third obstacle associated with the third or back side 314. The flat back surface 314 is also referred to as a coextensive obstacle. The flat back surface 314 is not a protrusion obstacle. Although the putting trainer 300 is shown with a flat back surface 314, alternative putting trainers could have a protrusion obstacle on the third side 314.

In addition to the described protrusion obstacles (e.g. curved protrusions or offset flat obstacles), other protrusion obstacles include, but are not limited to, triangular obstacles, pointed obstacles, or any other structure that protrudes from the majority of the face of the side. The protrusion obstacles may be, for example, small, medium, or large protrusions. The position of the protrusion obstacles may also be adjusted (e.g. left or right, or higher or lower) depending on the skill to be learned by the golfer. The putting trainer 300 may have, for example, a single type of protrusion obstacle, but different sizes of the same type of protrusion obstacle.

Unlike the second putting trainer 200 which is shown as having obstacles of different shapes, the third putting trainer 300 is shown as having obstacles of different sizes. Larger obstacles would generally be easier to hit and smaller obstacles would generally be harder to hit. Having obstacles of different sizes allows a user to use the putting trainer 300 to practice at different levels. For example, the shown putting trainer 300 has a side/protrusion for the novice or amateur golfer (the large protrusion obstacle 350), a side/protrusion for the casual or social golfer, and a side/protrusion for the pro golfer (the coextensive obstacle).

The putting trainer 300 is shown as having optional sight lines 340, 342, 344 on the upper surface of the body 310. There are three sight lines 340, 342, 344 shown, each one starting generally from a side 314, 316, 318 and extending generally to the opposite point or vertex. The sight lines 340, 342, 344 may be used for lining up the putting trainer 300 with the target 50. Some golf balls have arrows, lines, or other indicators printed on their surfaces that indicate the best position to hit the ball and, if hit there, the direction that the ball will travel. These arrows, lines, or other indicators can be aligned with the sight lines 340, 342, 344.

The putting trainer 300 is shown as having optional feet 370 on the bottom surface of the body 310. The feet 370 may be replaced with castors or wheels. If there are feet 370 associated with the lower surface of the body 310, then the bottom of the feet 370 become the lower surface that should be generally smooth for traveling.

Fourth Putting Trainer

FIGS. 37-43 show an exemplary preferred fourth putting trainer 400. The putting trainer 400 is shown as having a generally polygonal body 410 with a mock golf ball 430 (shown as half of a real golf ball, but it could be a fake golf ball) associated with the top surface thereof. The body 400 may have at least one optional sight line 440 on the upper surface for lining up with the target 50. (Line 442 is technically not a sight line, although it may be of assistance to the user.)

As set forth, the putting trainer 400 is shown as having a generally polygonal body 410. The shown putting trainer 400 has a front 412 (which is shown as a point or vertex), a back 414 (which is also referred to as a back side 414), and two sides 416 and 418 connecting the front 412 and the back 414. It should be noted that sides 416 and 418 are not straight, but actually include two faces each. This exemplary putting trainer 400 has only a single obstacle which, in this case, is shown as a coextensive obstacle.

The shown mock golf ball 430 on the upper surface of the body 410 may be used to assist a golfer in picturing a golfing scenario. The shown mock golf ball 430 is shown as half of a real golf ball that is associated with the upper surface of the body 410. This is shown as being accomplished by drilling a channel 432 and inserting a bolt 434 that extends through the channel 432 and into the mock golf ball 430. Alternative connections include, but are not limited to, friction, other mechanical connections, adhesives, magnets, and other known or yet to be discovered means for connection. The mock golf ball may also be formed integrally with the body. Although shown as half of a real golf ball, the mock golf ball 430 could be a fake golf ball. Alternatively, the mock golf ball 430 can be replaced with novelty items. The upper surface of the body 410 may also be bare or decorated with ornamental decorations or advertising (e.g. a company logo).

The obstacle of the shown putting trainer 400 is a coextensive obstacle (the flat back surface 414). The coextensive obstacle could be replaced with alternative obstacles such as those described herein to a novice or amateur golfer, a casual or social golfer, a scratch golfer, and/or a pro golfer. As will be discussed in relation to the fifth putting trainer 500 and sixth putting trainer 600, a single body may be used with different adapters or the cavity may be adaptable.

The putting trainer 400 is shown as having at least one optional sight line 440 on the upper surface of the body 410. The sight line 440 may be used for lining up the putting trainer 400 with the target 50. Some golf balls have arrows, lines, or other indicators printed on their surfaces that indicate the best position to hit the ball and, if hit there, the direction that the ball will travel. These arrows, lines, or other indicators can be aligned with the sight line 440.

It should be noted that, although not shown with feet, the putting trainer 400 may include feet (or similar structure). The body 410 may have alternative shapes such as triangular, arrow, or chevron.

Fifth Putting Trainer

FIGS. 45-49 show an exemplary preferred fifth putting trainer 500 that is similar to the first putting trainer 100, but having exemplary adapters 580 and 582 that are removable and replaceable from the body 510 of the fifth putting trainer 500. One advantage of fifth putting trainer 500 is that it allows a user to purchase a single body 510, but have the ability to change the adapters 580 and 582 for a challenge or to adjust for his ability.

The putting trainer 500 is shown as having a generally triangular body 510 (but it could have other shapes including, for example, the polygonal shape of the fourth putting trainer 400). The shown putting trainer 500 has a front 512 (which is shown as a point or vertex), a back 514 (which is also referred to as a back side 514), and two sides 516 and 518 connecting the front 512 and the back 514. This exemplary putting trainer 500 has only a single obstacle which, in this case is a portion of a golf ball 530 that protrudes from the back side 514. It should be noted that the adapter system could be used on multiple sides, not just a single side, if the body 510 was large enough.

Figure 45:
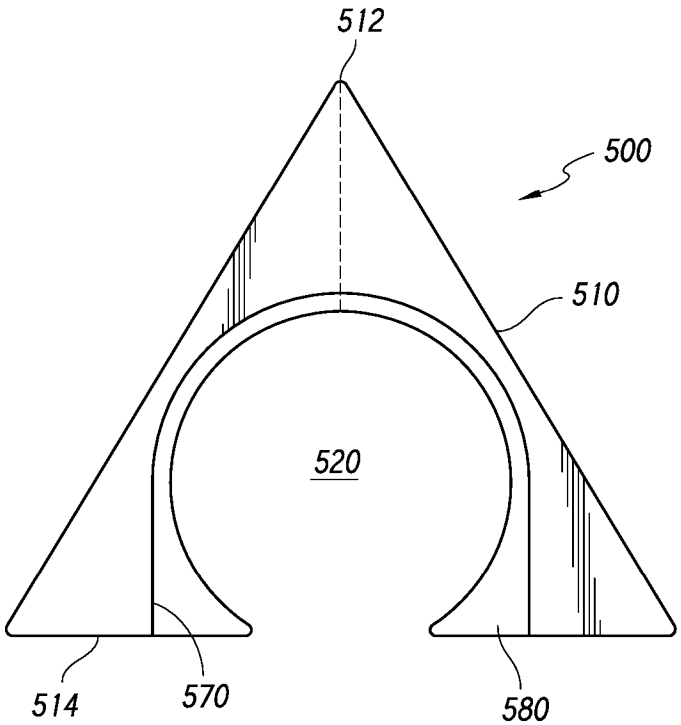
FIG. 45 is a top view of the exemplary preferred fifth putting trainer that is similar to the first putting trainer, but having a first exemplary adapter positioned within the body of the fifth putting trainer.
Figure 47:
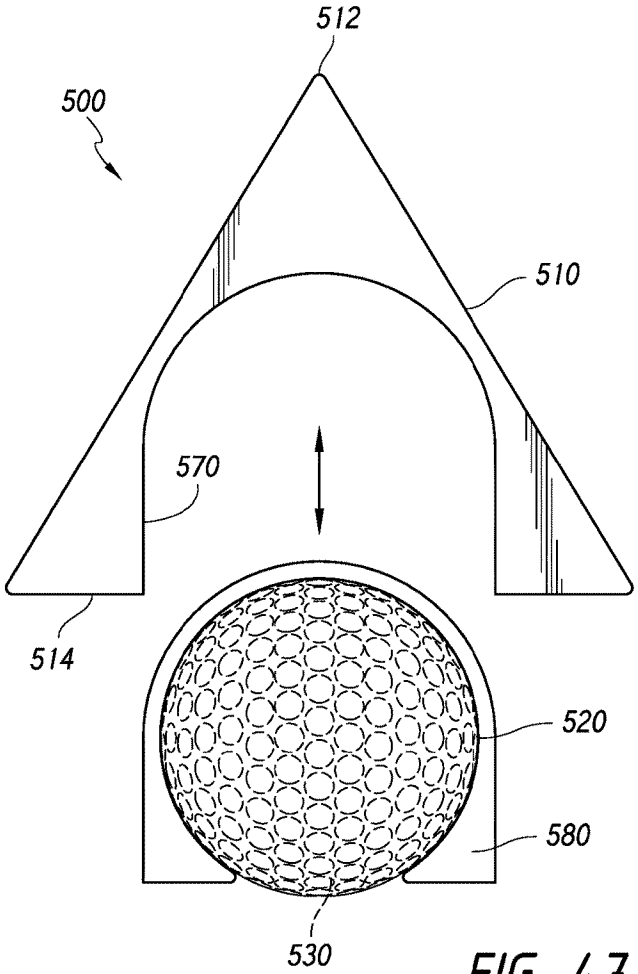
FIG. 47 is a top view of the exemplary preferred fifth putting trainer with the first exemplary adapter distal from the body of the fifth putting trainer, a golf ball (in phantom) positioned within the first adapter.
Figure 46:
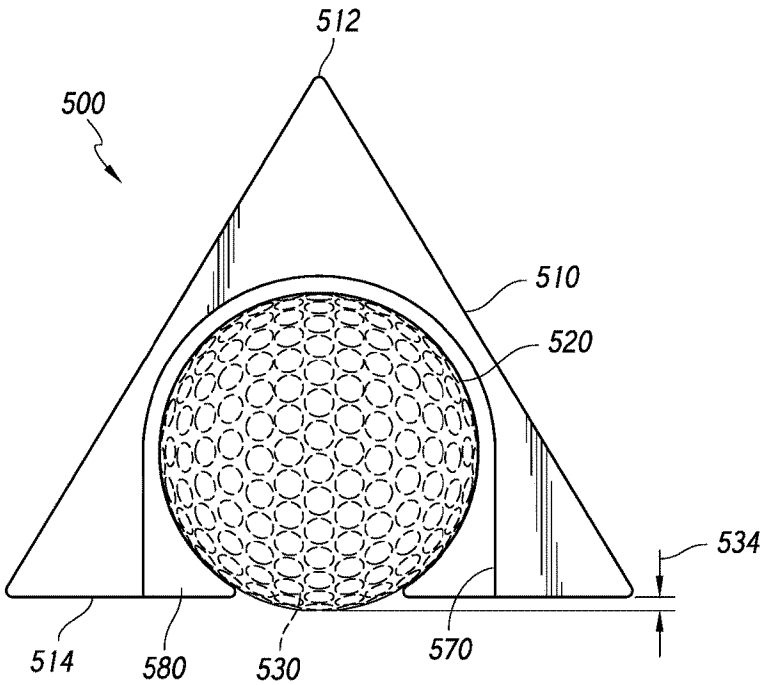
FIG. 46 is a top view of the exemplary preferred fifth putting trainer with the first exemplary adapter positioned within the body of the fifth putting trainer, a golf ball (in phantom) positioned within the first adapter.

FIG. 45 shows the putting trainer 500 with the first adapter 580 positioned within the recess 570 of the body 510. FIG. 46 shows the putting trainer 500 with the first adapter 580 positioned within the recess 570 of the body 510, and the golf ball 530 (in phantom) positioned within the cavity 520 of the first adapter 580. When assembled, the protrusion protrudes (sticks out) a first distance (shown as 534) from the back side 514. FIG. 47 shows the putting trainer 500 with the first adapter 580 distal from the body 510 and the golf ball 530 (in phantom) positioned within the cavity 520 of the first adapter 580. The first adapter 580 may be secured within the recess 570 of the body 510 using friction (e.g. a perfect fit), mechanical means (e.g. screws or clamps), adhesives, magnets, or other attachment means known or yet to be discovered.

Figure 49:
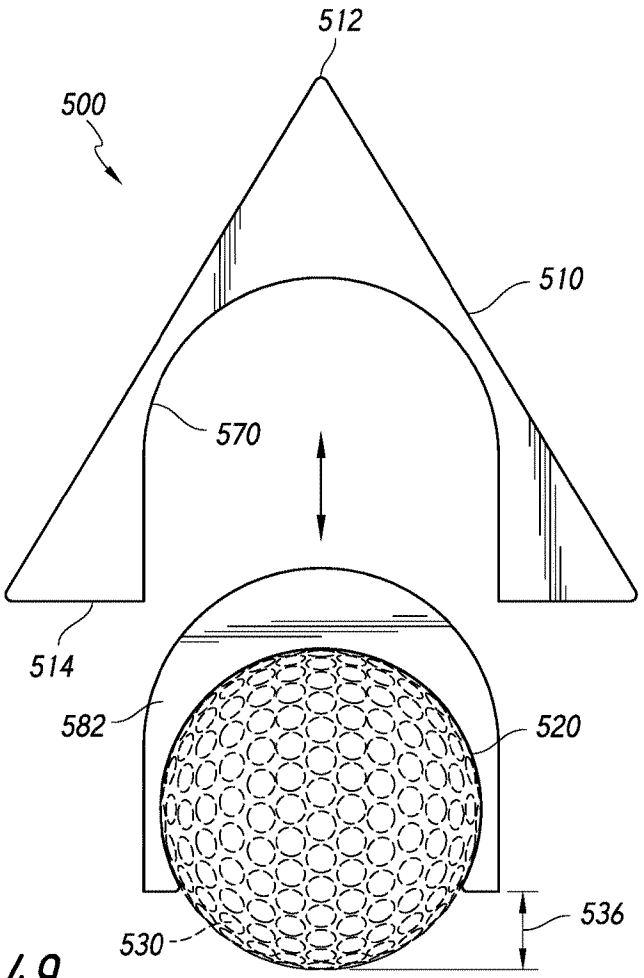
FIG. 49 is a top view of the exemplary preferred fifth putting trainer with the second exemplary adapter distal from the body of the fifth putting trainer, a golf ball (in phantom) positioned within the second adapter.
Figure 48:
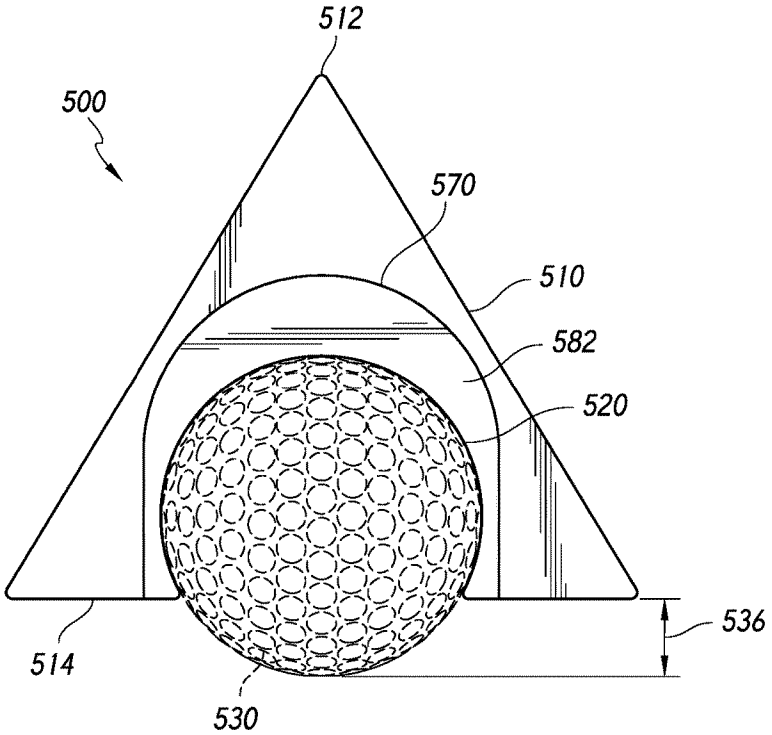
FIG. 48 is a top view of the exemplary preferred fifth putting trainer with a second exemplary adapter positioned within the body of the fifth putting trainer, a golf ball (in phantom) positioned within the second adapter.

FIG. 48 shows the putting trainer 500 with the second adapter 582 positioned within the recess 570 of the body 510, and the golf ball 530 (in phantom) positioned within the cavity 520 of the second adapter 582. When assembled, the protrusion protrudes (sticks out) a second distance (shown as 536) from the back side 514. FIG. 49 shows the putting trainer 500 with the second adapter 582 distal from the body 510 and the golf ball 530 (in phantom) positioned within the cavity 520 of the second adapter 582. The second adapter 582 may be secured within the recess 570 of the body 510 using friction (e.g. a perfect fit), mechanical means (e.g. screws or clamps), adhesives, magnets, or other attachment means known or yet to be discovered.

Although both the first adapter 580 and the second adapter 582 fit into the recess 570 of the body 510, the adapters 580, 582 are constructed so that the obstacles protrude at different distances 534, 536. Additional adapters could be constructed that have alternative obstacles that protrude at still different distances. Additional adapters could be constructed that have alternative obstacles of different shapes and sizes.

It should be noted that, although shown as having a golf ball 530 that is removable and replaceable from a cavity 520 (similar to the first putting trainer 100), the exemplary adapters 580 and 582 could have a flat upper surface and integral obstacles (e.g. offset flat obstacles, curved protrusion obstacles, or other obstacles discussed herein). The upper surface may have a mock golf ball (similar to putting trainer 400).

It should be noted that, once in position, the adapters 580 and 582 can be considered to be part of the body 510 such that a cavity 520 defined in an adapter 580, 582 can be considered to be part of the body 510.

Sixth Putting Trainer

Figure 51:
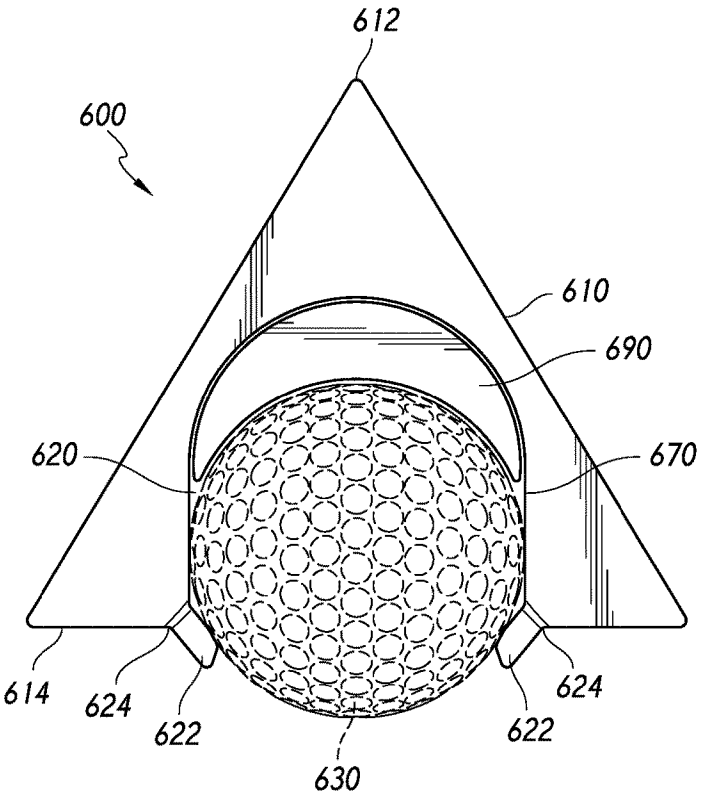
FIG. 51 is a top view of the exemplary preferred sixth putting trainer with an adjustable cavity defined therein, a spacer and a golf ball (in phantom) positioned within the cavity.
Figure 50:
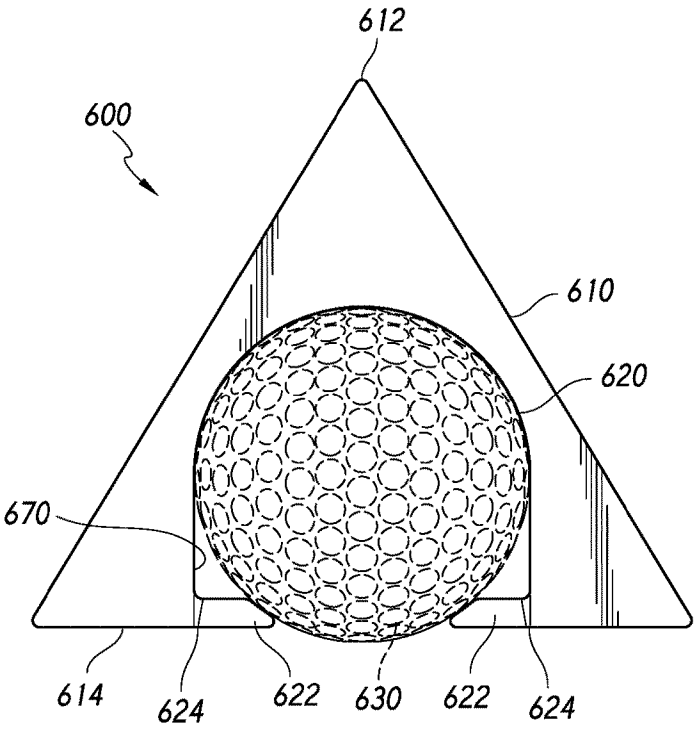
FIG. 50 is a top view of the exemplary preferred sixth putting trainer with an adjustable cavity defined therein, a golf ball (in phantom) positioned within the cavity.

FIGS. 50-51 show an exemplary preferred sixth putting trainer 600 that is similar to the first putting trainer 100, but allows adjustment of the protrusion using a spacer 690. This putting trainer 600 can be described as an adjustable putting trainer. One advantage of sixth putting trainer 600 is that it allows a user to purchase a single body 610, but have the ability to change the spacer 690 for a challenge or to adjust for his ability.

The putting trainer 600 is shown as having a generally triangular body 610 (but it could have other shapes including, for example, the polygonal shape of the fourth putting trainer 400). The shown putting trainer 600 has a front 612 (which is shown as a point or vertex), a back 614 (which is also referred to as a back side 614), and two sides 616 and 618 connecting the front 612 and the back 614. This exemplary putting trainer 600 has only a single obstacle which, in this case is a portion of a golf ball 630 that protrudes from the back side 614. It should be noted that the adjustment system could be used on multiple sides, not just a single side, if the body 610 was large enough.

FIG. 50 shows the putting trainer 600 with the golf ball 630 (in phantom) positioned within the recess 670 of the body 610. Fingers 622 hold the golf ball 630 within the recess 670. The fingers 622 may have flex mechanisms and/or hinges 624 that have sufficient resistance to retain the golf ball 630 substantially within the recess 670. When assembled, the golf ball 630 protrudes (sticks out) a first distance from the back side 614.

FIG. 51 shows the putting trainer 600 with a spacer 690 and the golf ball 630 (in phantom) positioned within the recess 670 of the body 610. Fingers 622 hold the golf ball 630 within the recess 670, but the spacer forces the fingers 622 outward to allow the golf ball 630 to protrude further. When assembled with the spacer 690, the golf ball 630 protrudes (sticks out) a second distance from the back side 614.

Using different spacers, a user could adjust the distance of the protrusion of the golf ball 630 to the desired distance. It should be noted that the spacer 690 may be adjustable (e.g. inflatable) so that multiple spacers are not necessary.

Materials

Preferred putting trainers 30 are preferably able to slide, glide, or skid on at least smooth putting surfaces 40. The "smoother" the putting trainer 30 (or at least the bottom surface thereof), the better the putting trainer 30 will slide. Similarly, the "smoother" the putting surfaces 40, the better the putting trainer 30 will slide. Although sliding is important, the putting trainer 30 should not slide too far or it would partially defeat its purpose of being able to show a trajectory, but not have to be chased after every practice contact.

The phrase "coefficient of friction" (COF) describes the relationship between the force of friction between two objects and the normal force between those objects. There is a preferred coefficient of friction. The COF depends significantly on the materials of both the putting trainer 30 and the putting surface 40. COFs range from near zero to greater than one. Because preferred putting trainers 30 can be used on a variety of putting surfaces 40 (including those present and available wherever the golfer might choose to practice), a relatively smooth putting trainer 30 (or at least the bottom surface thereof) will be preferred to keep the COF between the putting trainer 30 and the putting surface 40 ideal. If the putting trainers 30 and the putting surface 40 are sold together, the putting trainer 30 (or at least the bottom surface thereof) may be not quite as smooth because the smoothness of the putting surface 40 can be adjusted to keep the ideal COF between the putting trainer 30 and the putting surface.

The entire putting trainer 30 or just the bottom surface of the putting trainer 30 may be made of suitable materials. Exemplary suitable materials with which the putting trainers 30 may be made include, but are not limited to, plastics (e.g.

those having low COFs, such as phenolics, acetals, Teflon® (PTFE), ultra high molecular weight polyethylene (UHMWPE), and nylon), acrylics, metal (e.g. brass, bronze, copper, steel, tin, zinc), glass, graphite, wood, and any other "smooth" material. The body of the putting trainer 30 and/or bottom surface of the body can be coated with suitable material so that the appropriate surface is smooth. For example, coatings such as an electroless nickel infused with Teflon® (Surface Technology, Inc. in Trenton, N.J.) of Delrin® 500 AF (a Teflon® fiber filled resin created by DuPont), can be added to the bottom of a putting trainer 30 made from other materials. Felt, graphite, wax, glazes (including crystalline oxide layer glaze), oils, greases, and other smoothing coatings or substances known or yet to be discovered can be used to create the smooth surface.

Instead of (or in addition to) the putting trainer 30, feet may be added that have a suitable smooth texture. Exemplary feet are shown in association with some of the shown putting trainers 30. These feet may be the same suitable materials discussed above. If there are feet associated with the lower surface of the putting trainer 30, then the bottom of the feet become the lower surface that should be generally smooth for traveling.

The friction sliders and glides made of plastic and felt, such as those used to move furniture, can be added to the bottom of various materials to decrease the COF. U.S. Pat. No. 1,988,377 to Fruchter (the "Fruchter reference") disclosed a glide for furniture legs, that is a single piece of material with a fibrous pad secured to the underside of the glide. U.S. Pat. No. 5,573,212 to Palazzolo (the "Palazzolo reference") is directed to a glide block for moving loads, and more specifically, glide blocks for moving furniture, that are provided with a cup of synthetic material coming in contact with the floor. Other sliders, such as the self-adhesive plastic Magic Sliders®, can be purchased via the Internet at www.magicsliders.com. Master Caster Company has the Master Caster® Mighty Might Furniture Sliders, made of a polymer plastic, among other products in their product line.

Using an Obstacle Putting Trainer

Using an exemplary putting trainer 100 with a single obstacle, FIG. 2 shows square contact and the results thereof, and FIGS. 3 and 4 show angled (incorrect) contact and the results thereof. As shown in FIG. 2, if the golf club 20 contacts squarely with an obstacle associated with a side of the putting trainer 100, the square contact causes the putting trainer 100 to travel in a preferred forward direction (straight trajectory) towards the target 50. As shown in FIG. 3, if the golf club 20 contacts the putting trainer 100 on the right side of the obstacle (shown as a portion of the golf club 20 head toward the toe end making contact), the putting trainer 100 travels in a leftward direction, which is not the preferred direction. As shown in FIG. 4, if the putting trainer 100 golf club 20 contacts the putting trainer 100 on the left side of the obstacle (shown as a portion of the golf club 20 head toward the heel end making contact), the putting trainer 100 travels in a rightward direction, which is not the preferred direction.

Figure 12:
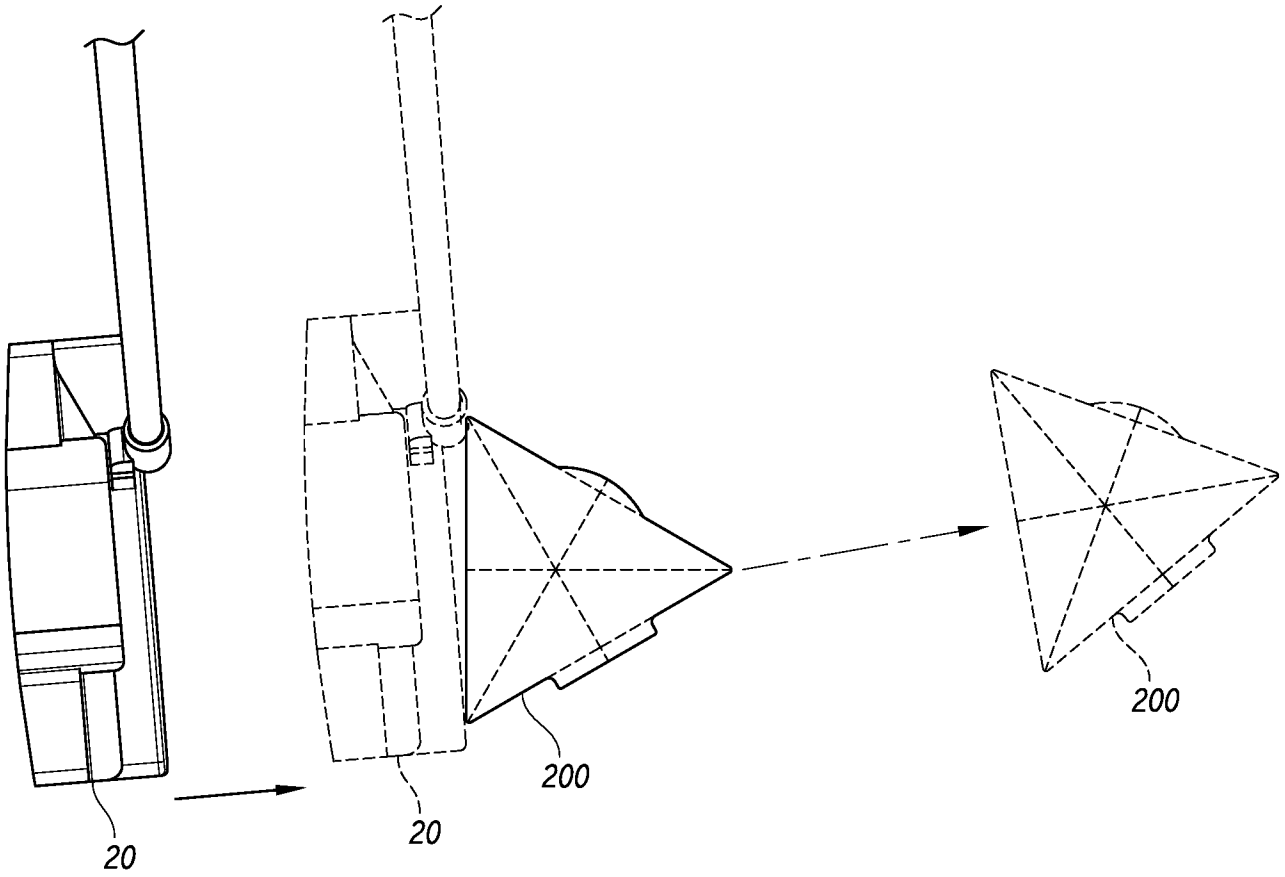
FIG. 12 is a top view of the exemplary preferred second putting trainer of FIG. 11, with a golf club contacting with the putting trainer on the right side of the coextensive obstacle such that the putting trainer travels in a leftward direction, which is not the preferred direction.
Figure 13:
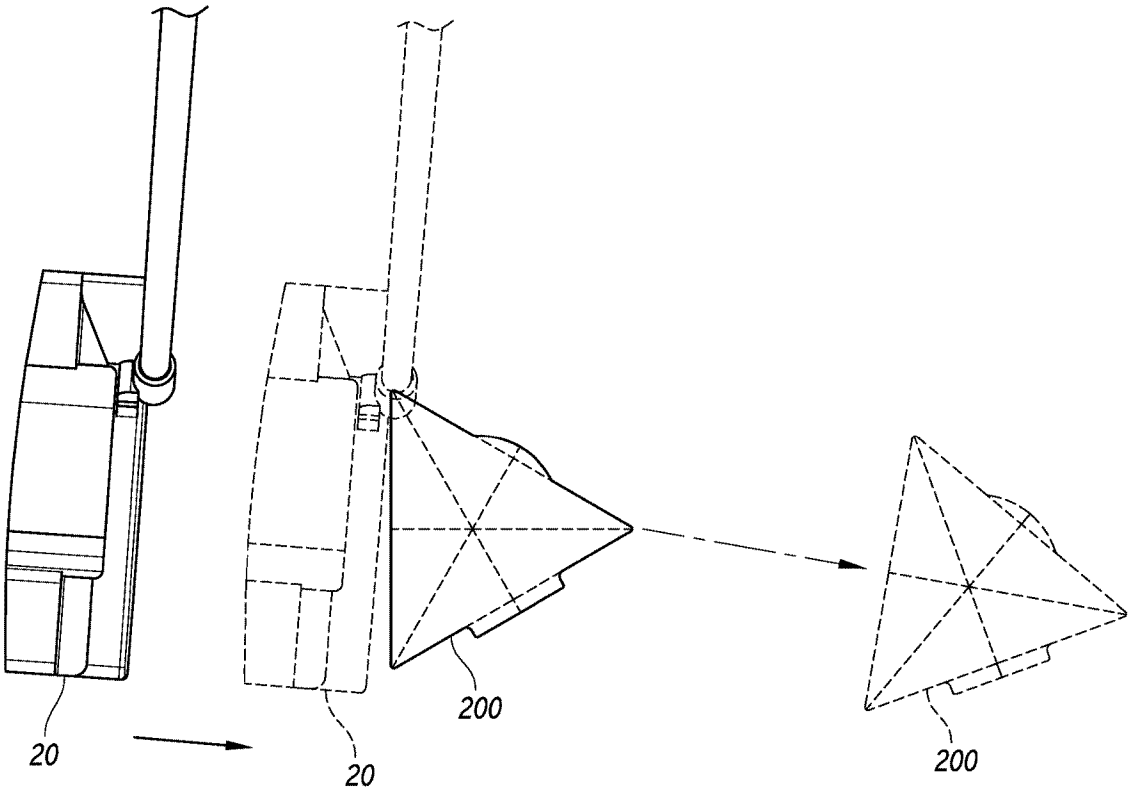
FIG. 13 is a top view of the exemplary preferred second putting trainer of FIG. 11, with a golf club contacting with the putting trainer on the left side of the coextensive obstacle such that the putting trainer travels in a rightward direction, which is not the preferred direction.
Figure 15:
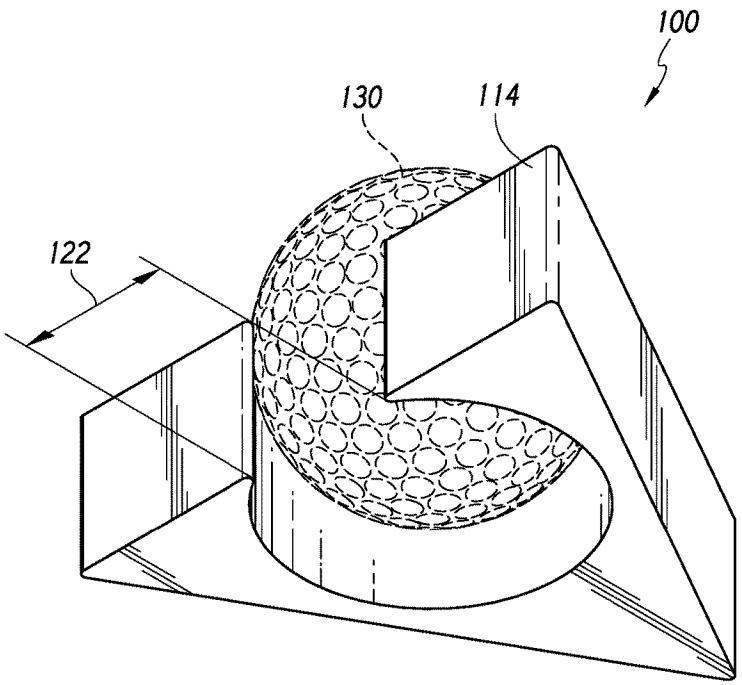
FIG. 15 is a bottom perspective view of the exemplary preferred first putting trainer of FIG. 14.
Figure 14:
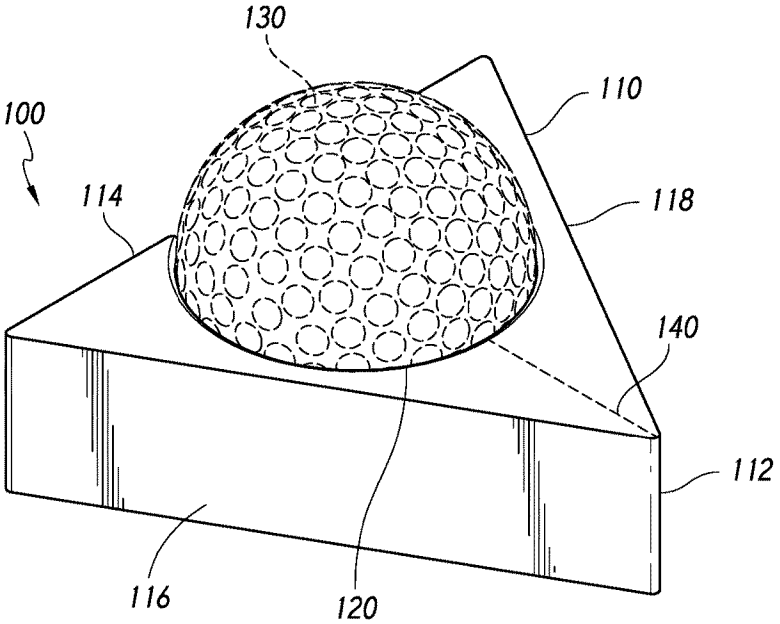
FIG. 14 is a top perspective view of an exemplary preferred first putting trainer, the putting trainer shown as generally triangular with a cavity having a diameter sufficient to hold a golf ball, the triangular body having an optional sight line on the upper surface for lining up with the target.

Using an exemplary putting trainer 200 with three different obstacles, each obstacle has its own difficulty level or challenge, but the result is the same. FIGS. 5, 8, and 11 show square contact and the results thereof, and FIGS. 6-7, 9-10, and 12-13 show angled (incorrect) contact and the results thereof. As shown in FIGS. 5, 8, and 11, if the golf club 20 contacts squarely with an obstacle associated with a side of the putting trainer 200, the square contact causes the putting trainer 200 to travel in a preferred forward direction (straight trajectory) towards the target 50. As shown in FIGS. 6, 9, and 12, if the golf club 20 contacts the putting trainer 200 on the right side of the obstacle (shown as a portion of the golf club 20 head toward the toe end making contact), the putting trainer 200 travels in a leftward direction, which is not the preferred direction. As shown in FIGS. 7, 10, and 13, if the putting trainer 200 golf club 20 contacts the putting trainer 200 on the left side of the obstacle (shown as a portion of the golf club 20 head toward the heel end making contact), the putting trainer 200 travels in a rightward direction, which is not the preferred direction.

It is to be understood that the inventions, examples, and embodiments described herein are not limited to particularly exemplified materials, methods, and/or structures. It is to be understood that the inventions, examples, and embodiments described herein are to be considered preferred inventions, examples, and embodiments whether specifically identified as such or not. The shown inventions, examples, and embodiments are preferred, but are not meant to be limiting unless specifically claimed, in which case they may limit the scope of that particular claim.

All references (including, but not limited to, foreign and/or domestic publications, patents, and patent applications) cited herein, whether supra or infra, are hereby incorporated by reference in their entirety.

The terms and expressions that have been employed in the foregoing specification are used as terms of description and not of limitation, and are not intended to exclude equivalents of the features shown and described. While the above is a complete description of selected embodiments of the present invention, it is possible to practice the invention using various alternatives, modifications, adaptations, variations, and/or combinations and their equivalents. It will be appreciated by those of ordinary skill in the art that any arrangement that is calculated to achieve the same purpose may be substituted for the specific embodiment shown. It is also to be understood that the following claims are intended to cover all of the generic and specific features of the invention herein described and all statements of the scope of the invention that, as a matter of language, might be said to fall therebetween.

What is claimed is:

1. A putting trainer for practicing golfing with a golf club with a head, said putting trainer for use on a generally smooth putting surface, comprising:

(a) a body having a top surface, a bottom surface, and a plurality of exterior sides connecting said top surface to said bottom surface, said bottom surface being suitable for traveling, each exterior side having a length; and (b) an obstacle protruding from and at least generally centered along the length of at least part of one of said plurality of exterior sides;

(c) wherein contacting said obstacle squarely with the head of the golf club causes said putting trainer to travel in a preferred forward direction, but contacting said obstacle off from square with the head of the golf club causes said putting trainer to travel in an undesired angle.

2. The putting trainer of claim 1, said body having a cavity defined therein, said cavity intersecting said one of said plurality of exterior sides to form an opening in said one of said plurality of exterior sides, said obstacle protruding from said opening in said one of said plurality of exterior sides.

3. The putting trainer of claim 1, said body having a cavity defined therein, said cavity intersecting said one of said plurality of exterior sides to form an opening in said one of said plurality of exterior sides, a golf ball positioned at least partially within said cavity, said obstacle being part of said golf ball protruding from said opening in said one of said plurality of exterior sides.

4. The putting trainer of claim 1, at least one of said plurality of exterior sides being free from structure extending outward from said body.

5. The putting trainer of claim 1, said obstacle being at least two obstacles, a first obstacle protruding from a first one of said plurality of exterior sides, and a second obstacle protruding from a second one of said plurality of exterior sides.

6. The putting trainer of claim 1, said obstacle being at least two protruding obstacles, a first protruding obstacle protruding from a first one of said plurality of exterior sides, and a second protruding obstacle protruding from a second one of said plurality of exterior sides.

7. The putting trainer of claim 1, said obstacle being at least two obstacles, a first obstacle protruding from a first one of said plurality of exterior sides, and a second obstacle protruding from a second one of said plurality of exterior sides, said first obstacle being a different type of obstacle than said second obstacle.

8. The putting trainer of claim 1, said obstacle being at least two obstacles, a first obstacle protruding from a first one of said plurality of exterior sides, and a second obstacle protruding from a second one of said plurality of exterior sides, said first obstacle being a different size than said second obstacle.

9. The putting trainer of claim 1, said obstacle being a removable and replaceable obstacle.

10. The putting trainer of claim 1, at least said bottom surface being suitable for traveling on a smooth surface, a specially adapted putting surface, or a hardwood floor.

11. The putting trainer of claim 1, said putting trainer being an adjustable putting trainer in which said obstacle can be adjusted to different extension distances.

12. The putting trainer of claim 1, said body being a generally triangular body and said plurality of exterior sides being three exterior sides.

13. The putting trainer of claim 1, other than said obstacle protruding from and at least generally centered along the length of at least part of one of said plurality of exterior sides, said one of said plurality of exterior sides being free from structure extending outward from said body.

14. The putting trainer of claim 1, said one of said plurality of exterior sides from which said obstacle protrudes being free from structure extending beyond said obstacle.

15. A putting trainer for practicing golfing with a golf club with a head, said putting trainer for use on a generally smooth putting surface, comprising:

(a) a body having a top surface, a bottom surface, and a plurality of exterior sides connecting said top surface to said bottom surface, said bottom surface being suitable for traveling;

(b) a cavity defined in said body, said cavity intersecting said one of said plurality of exterior sides to form an opening in said one of said plurality of exterior sides; and (c) a protrusion obstacle protruding from said opening in said one of said plurality of exterior sides;

(d) wherein contacting said protrusion obstacle squarely with the head of the golf club causes said putting trainer to travel in a preferred forward direction, but contacting said protrusion obstacle off from square with the head of the golf club causes said putting trainer to travel in an undesired angle.

16. The putting trainer of claim 15, a golf ball positioned at least partially within said cavity, said protrusion obstacle being part of said golf ball protruding from said opening in said one of said plurality of exterior sides.

17. The putting trainer of claim 15, said putting trainer being an adjustable putting trainer in which said protrusion obstacle can be adjusted to different extension distances.

18. The putting trainer of claim 15, at least one of said plurality of exterior sides being free from structure extending outward from said body.

19. The putting trainer of claim 15, at least said bottom surface being suitable for traveling on a smooth surface, a specially adapted putting surface, or a hardwood floor.

20. The putting trainer of claim 15, each exterior side having a length, said protrusion obstacle at least generally centered along the length of one of said plurality of exterior sides.

21. The putting trainer of claim 15, other than said protrusion obstacle, said one of said plurality of exterior sides being free from structure extending outward from said body.

22. The putting trainer of claim 15, said one of said plurality of exterior sides from which said protrusion obstacle protrudes being free from structure extending beyond said protrusion obstacle.

23. A putting trainer for practicing golfing with a golf club with a head, said putting trainer for use on a generally smooth putting surface, comprising:

(a) a generally triangular body having a top surface, a bottom surface, and three exterior sides connecting said top surface to said bottom surface, said bottom surface being suitable for traveling; and (b) at least two protrusion obstacles, a first protrusion obstacle protruding from a first one of said exterior sides, and a second protrusion obstacle protruding from a second one of said exterior sides;

(c) wherein contacting one said protrusion obstacles squarely with the head of the golf club causes said putting trainer to travel in a preferred forward direction, but contacting one said protrusion obstacles off from square with the head of the golf club causes said putting trainer to travel in an undesired angle.

24. The putting trainer of claim 23, said first protrusion obstacle being a different type of protrusion obstacle than said second protrusion obstacle.

25. The putting trainer of claim 23, said first protrusion obstacle being a different size than said second protrusion obstacle.

26. The putting trainer of claim 23, at least one of said protrusion obstacles being a removable and replaceable protrusion obstacle.

27. The putting trainer of claim 23, each exterior side having a length, said first protrusion obstacle at least generally centered along the length of said first one of said exterior sides, said second protrusion obstacle at least generally centered along the length of said second one of said exterior sides.

28. The putting trainer of claim 23, a third one of said exterior sides being free from structure extending outward from said body.

29. The putting trainer of claim 23, other than said first protrusion obstacle, said first one of said exterior sides being free from structure extending outward from said body, and other than said second protrusion obstacle, said second one of said exterior sides being free from structure extending outward from said body.

30. The putting trainer of claim 23, said first one of said exterior sides from which said first protrusion obstacle protrudes being free from structure extending beyond said first protrusion obstacle, and said second one of said exterior sides from which said second protrusion obstacle protrudes being free from structure extending beyond said second protrusion obstacle.

* * * * *